US009939786B2

(12) United States Patent
Kusakawa

(10) Patent No.: US 9,939,786 B2
(45) Date of Patent: Apr. 10, 2018

(54) DEVICE FOR MOTOR-DRIVEN APPLIANCE

(71) Applicant: MAKITA CORPORATION, Anjo-shi, Aichi (JP)

(72) Inventor: Takuya Kusakawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 0 days.

(21) Appl. No.: 14/263,245

(22) Filed: Apr. 28, 2014

(65) Prior Publication Data

US 2014/0334270 A1 Nov. 13, 2014

(30) Foreign Application Priority Data

May 7, 2013 (JP) ..... 2013-097673

(51) Int. Cl.

| | |
|---|---|
| ***G04G 9/00*** | (2006.01) |
| ***B25B 21/00*** | (2006.01) |
| ***B25B 23/14*** | (2006.01) |
| *G07C 3/00* | (2006.01) |

(52) U.S. Cl.

CPC ..... *G04G 9/00* (2013.01); *B25B 21/00* (2013.01); *B25B 23/14* (2013.01); *G07C 3/00* (2013.01)

(58) Field of Classification Search

CPC ... G04G 5/00; G04G 9/00; G07C 3/00; H04Q 7/20; B25B 21/00; B25B 23/14

USPC ..... 702/187; 368/5

See application file for complete search history.

(56) References Cited

U.S. PATENT DOCUMENTS

| | | | | |
|---|---|---|---|---|
| 5,038,084 | A * | 8/1991 | Wing | H02P 25/14 318/268 |
| 6,260,004 | B1 | 7/2001 | Hays et al. | |
| 7,823,486 | B2 * | 11/2010 | Wise | B25B 13/46 81/467 |
| 9,158,287 | B2 * | 10/2015 | Ono | G04R 20/18 |
| 9,534,486 | B2 * | 1/2017 | Wisinger, Jr. | E21B 47/00 |
| 2004/0042345 | A1 * | 3/2004 | Kawaguchi | G04C 9/02 368/47 |
| 2004/0111339 | A1 * | 6/2004 | Wehrung | G06Q 40/12 705/30 |
| 2005/0148341 | A1 * | 7/2005 | Chang | 455/456.2 |

(Continued)

FOREIGN PATENT DOCUMENTS

| | | |
|---|---|---|
| JP | H08-216045 A | 8/1996 |
| JP | 2003-106625 A | 4/2003 |

(Continued)

OTHER PUBLICATIONS

English Machine Translation of Watanabe, JP 2006320984, translated Jan. 29, 2015.*

(Continued)

*Primary Examiner* — Sean Kayes
(74) *Attorney, Agent, or Firm* — Oliff PLC

(57) ABSTRACT

A device for a motor-driven appliance includes a communication unit, a date/time information acquisition unit, and a control unit. The communication unit performs communication with an external appliance having a date/time information indicating a current date and time. The date/time information acquisition unit acquires the date/time information from the external appliance via the communication unit. The control unit performs control based on the date/time information acquired by the date/time information acquisition unit.

11 Claims, 31 Drawing Sheets

(56) References Cited

U.S. PATENT DOCUMENTS

2006/0287757 A1* 12/2006 Brodin et al. ..... 700/168
2007/0150235 A1* 6/2007 Lev-Ami et al. ..... 702/182
2007/0244471 A1* 10/2007 Malackowski ..... H01M 10/42 606/1
2008/0027683 A1* 1/2008 Middleton et al. ..... 702/187
2009/0111520 A1* 4/2009 Ring ..... 455/557
2010/0018770 A1* 1/2010 Moriarty ..... E21B 7/04 175/45
2010/0155139 A1* 6/2010 Kuckes ..... E21B 47/02216 175/45
2010/0214094 A1* 8/2010 Givens et al. ..... 340/539.17
2010/0322267 A1* 12/2010 Homma et al. ..... 370/503
2012/0022324 A1* 1/2012 Forsell ..... A61F 2/26 600/40
2012/0151093 A1* 6/2012 Zheng ..... G04G 7/02 709/248
2013/0027216 A1* 1/2013 Jantz ..... E21B 47/122 340/854.4
2013/0087723 A1* 4/2013 Pelletier ..... H01J 63/00 250/504 R
2013/0168119 A1* 7/2013 Xu ..... B25B 21/026 173/94
2013/0293159 A1* 11/2013 Straub ..... B25F 5/00 318/17
2014/0240125 A1 8/2014 Burch et al.

FOREIGN PATENT DOCUMENTS

JP 2005-135640 A 5/2005
JP A-2006-320984 11/2006
JP A-2010-012587 1/2010
JP 2011-172090 A 9/2011

OTHER PUBLICATIONS

Aug. 26, 2014 Extended European Search Report issued in European Application No. 14167042.2.
Aug. 30, 2016 Office Action issued in Japanese Application No. 2013-097673.
Feb. 26, 2018 Examination Report issued in European Patent Application No. 14 167 042.2.

* cited by examiner

FIG.4A

MEMORY CONTENT 1 (WHEN SHIFTING TO SLEEP)

| | | | | | |
|---|---|---|---|---|---|
| 1 | NUMBER OF DETECTIONS OF DECREASE IN VOLTAGE | NUMBER OF DETECTIONS OF OVERLOAD | NUMBER OF DETECTIONS OF HIGH TEMPERATURE | NUMBER OF DETECTIONS OF BATTERY ABNORMALITY | NULL |
| 7 | DATE/TIME INFORMATION | | | | |

MEMORY CONTENT 2 (WHEN DETECTING DECREASE IN VOLTAGE)

| | | | | | | |
|---|---|---|---|---|---|---|
| 2 | MODE SETTING | MOTOR DRIVING TIME | BATTERY VOLTAGE | NULL | NULL | NULL |
| 7 | DATE/TIME INFORMATION | | | | | |
| 1 | NUMBER OF DETECTIONS OF DECREASE IN VOLTAGE | NUMBER OF DETECTIONS OF OVERLOAD | NUMBER OF DETECTIONS OF HIGH TEMPERATURE | NUMBER OF DETECTIONS OF BATTERY ABNORMALITY | | NULL |

MEMORY CONTENT 3 (WHEN DETECTING OVERLOAD)

| | | | |
|---|---|---|---|
| 3 | MODE SETTING | CURRENT DISTRIBUTION | MOTOR DRIVING TIME |
| 7 | DATE/TIME INFORMATION | | |
| 1 | NUMBER OF DETECTIONS OF DECREASE IN VOLTAGE | NUMBER OF DETECTIONS OF OVERLOAD | NUMBER OF DETECTIONS OF HIGH TEMPERATURE | NUMBER OF DETECTIONS OF BATTERY ABNORMALITY | NULL |

FIG.4B

MEMORY CONTENT 4 (WHEN DETECTING HIGH TEMPERATURE)

| | | | | | |
|---|---|---|---|---|---|
| 4 | MODE SETTING | CURRENT DISTRIBUTION | | MOTOR DRIVING TIME | |
| 7 | DATE/TIME INFORMATION | | | | |
| 1 | NUMBER OF DETECTIONS OF DECREASE IN VOLTAGE | NUMBER OF DETECTIONS OF OVERLOAD | NUMBER OF DETECTIONS OF HIGH TEMPERATURE | NUMBER OF DETECTIONS OF BATTERY ABNORMALITY | NULL |

MEMORY CONTENT 5 (WHEN DETECTING BATTERY ABNORMALITY)

| | | | | | |
|---|---|---|---|---|---|
| 5 | MODE SETTING | CONTROLLER TEMPERATURE | BATTERY STATUS INFORMATION | CURRENT DISTRIBUTION | |
| 7 | DATE/TIME INFORMATION | | | | |
| 1 | NUMBER OF DETECTIONS OF DECREASE IN VOLTAGE | NUMBER OF DETECTIONS OF OVERLOAD | NUMBER OF DETECTIONS OF HIGH TEMPERATURE | NUMBER OF DETECTIONS OF BATTERY ABNORMALITY | NULL |

MEMORY CONTENT 6 (WHEN SWITCHING MODE)

| | | | | | | | |
|---|---|---|---|---|---|---|---|
| 6 | MODE SETTING | CONTROLLER TEMPERATURE | BATTERY STATUS INFORMATION | NULL | NULL | NULL | NULL |
| 7 | DATE/TIME INFORMATION | | | | | | |
| 1 | NUMBER OF DETECTIONS OF DECREASE IN VOLTAGE | NUMBER OF DETECTIONS OF OVERLOAD | NUMBER OF DETECTIONS OF HIGH TEMPERATURE | NUMBER OF DETECTIONS OF BATTERY ABNORMALITY | | | NULL |

FIG.13A

MEMORY CONTENT 1 (WHEN SHIFTING TO SLEEP)

| | | | | | |
|---|---|---|---|---|---|
| 1 | NUMBER OF DETECTIONS OF OVERVOLTAGE | NUMBER OF DETECTIONS OF OVERCURRENT | NUMBER OF DETECTIONS OF CHARGING STATUS ABNORMALITY | NUMBER OF DETECTIONS OF BATTERY ABNORMALITY | NULL |
| 6 | DATE/TIME INFORMATION | | | | |

MEMORY CONTENT 2 (WHEN DETECTING OVERVOLTAGE)

| | | | | | | |
|---|---|---|---|---|---|---|
| 2 | STATUS INFORMATION | CHARGING ELAPSED TIME | CHARGING VOLTAGE AT ERROR | NULL | NULL | NULL |
| 6 | DATE/TIME INFORMATION | | | | | |
| 1 | NUMBER OF DETECTIONS OF OVERVOLTAGE | NUMBER OF DETECTIONS OF OVERCURRENT | NUMBER OF DETECTIONS OF CHARGING STATUS ABNORMALITY | NUMBER OF DETECTIONS OF BATTERY ABNORMALITY | | NULL |

MEMORY CONTENT 3 (WHEN DETECTING OVERCURRENT)

| | | | | | |
|---|---|---|---|---|---|
| 3 | STATUS INFORMATION | CHARGING CURRENT DISTRIBUTION | | CHARGING ELAPSED TIME | |
| 6 | DATE/TIME INFORMATION | | | | |
| 1 | NUMBER OF DETECTIONS OF OVERVOLTAGE | NUMBER OF DETECTIONS OF OVERCURRENT | NUMBER OF DETECTIONS OF CHARGING STATUS ABNORMALITY | NUMBER OF DETECTIONS OF BATTERY ABNORMALITY | NULL |

FIG.13B

MEMORY CONTENT 4 (WHEN DETECTING CHARGING STATUS ABNORMALITY)

| | | | | | |
|---|---|---|---|---|---|
| 4 | STATUS INFORMATION | CHARGING CURRENT DISTRIBUTION | | CHARGING ELAPSED TIME | |
| 6 | DATE/TIME INFORMATION | | | | |
| 1 | NUMBER OF DETECTIONS OF OVERVOLTAGE | NUMBER OF DETECTIONS OF OVERCURRENT | NUMBER OF DETECTIONS OF CHARGING STATUS ABNORMALITY | NUMBER OF DETECTIONS OF BATTERY ABNORMALITY | NULL |

MEMORY CONTENT 5 (WHEN DETECTING BATTERY ABNORMALITY)

| | | | | | |
|---|---|---|---|---|---|
| 5 | STATUS INFORMATION | BATTERY STATUS INFORMATION | | CHARGING ELAPSED TIME | |
| 6 | DATE/TIME INFORMATION | | | | |
| 1 | NUMBER OF DETECTIONS OF OVERVOLTAGE | NUMBER OF DETECTIONS OF OVERCURRENT | NUMBER OF DETECTIONS OF CHARGING STATUS ABNORMALITY | NUMBER OF DETECTIONS OF BATTERY ABNORMALITY | NULL |

FIG.19

MEMORY CONTENT 1 (WHEN SHIFTING TO SLEEP)

| | | | | |
|---|---|---|---|---|
| 1 | NUMBER OF DETECTIONS OF OVERVOLTAGE | NUMBER OF DETECTIONS OF OVERCURRENT | NUMBER OF DETECTIONS OF BATTERY ABNORMALITY | NULL |
| 5 | DATE/TIME INFORMATION + DIFFERENCE INFORMATION | | | |

MEMORY CONTENT 2 (WHEN DETECTING OVERVOLTAGE)

| | | | | | | |
|---|---|---|---|---|---|---|
| 2 | STATUS INFORMATION | CHARGING ELAPSED TIME | CHARGING VOLTAGE AT ERROR | NULL | NULL | NULL |
| 5 | DATE/TIME INFORMATION + DIFFERENCE INFORMATION | | | | | |
| 1 | NUMBER OF DETECTIONS OF OVERVOLTAGE | NUMBER OF DETECTIONS OF OVERCURRENT | NUMBER OF DETECTIONS OF BATTERY ABNORMALITY | NULL | | |

MEMORY CONTENT 3 (WHEN DETECTING OVERCURRENT)

| | | | |
|---|---|---|---|
| 3 | STATUS INFORMATION | CHARGING/DISCHARGING CURRENT DISTRIBUTION | CHARGING/DISCHARGING ELAPSED TIME |
| 5 | DATE/TIME INFORMATION + DIFFERENCE INFORMATION | | |
| 1 | NUMBER OF DETECTIONS OF OVERVOLTAGE | NUMBER OF DETECTIONS OF OVERCURRENT | NUMBER OF DETECTIONS OF BATTERY ABNORMALITY | NULL |

MEMORY CONTENT 3 (WHEN DETECTING OVERCURRENT)

| | | | |
|---|---|---|---|
| 4 | STATUS INFORMATION | BATTERY STATUS INFORMATION | CHARGING/DISCHARGING ELAPSED TIME |
| 5 | DATE/TIME INFORMATION + DIFFERENCE INFORMATION | | |
| 1 | NUMBER OF DETECTIONS OF OVERVOLTAGE | NUMBER OF DETECTIONS OF OVERCURRENT | NUMBER OF DETECTIONS OF BATTERY ABNORMALITY | NULL |

FIG.24A

MEMORY CONTENT 1 (WHEN SHIFTING TO SLEEP)

| | | | | | |
|---|---|---|---|---|---|
| 1 | NUMBER OF DETECTIONS OF DECREASE IN VOLTAGE | NUMBER OF DETECTIONS OF OVERLOAD | NUMBER OF DETECTIONS OF HIGH TEMPERATURE | NUMBER OF DETECTIONS OF BATTERY ABNORMALITY | NULL |
| 7 | DATE/TIME INFORMATION | | | | |

MEMORY CONTENT 2 (WHEN DETECTING DECREASE IN VOLTAGE)

| | | | | | | |
|---|---|---|---|---|---|---|
| 2 | MODE SETTING | MOTOR DRIVING TIME | BATTERY VOLTAGE | NULL | NULL | NULL |
| 7 | DATE/TIME INFORMATION | | | | | |

MEMORY CONTENT 3 (WHEN DETECTING OVERLOAD)

| | | | |
|---|---|---|---|
| 3 | MODE SETTING | CURRENT DISTRIBUTION | MOTOR DRIVING TIME |
| 7 | DATE/TIME INFORMATION | | |

FIG.24B

MEMORY CONTENT 4 (WHEN DETECTING HIGH TEMPERATURE)

| | | | |
|---|---|---|---|
| 4 | MODE SETTING | CURRENT DISTRIBUTION | MOTOR DRIVING TIME |
| 7 | DATE/TIME INFORMATION | | |

MEMORY CONTENT 5 (WHEN DETECTING BATTERY ABNORMALITY)

| | | | | |
|---|---|---|---|---|
| 5 | MODE SETTING | CONTROLLER TEMPERATURE | BATTERY STATUS INFORMATION | CURRENT DISTRIBUTION |
| 7 | DATE/TIME INFORMATION | | | |

MEMORY CONTENT 6 (WHEN SWITCHING MODE)

| | | | | | | | |
|---|---|---|---|---|---|---|---|
| 6 | MODE SETTING | CONTROLLER TEMPERATURE | BATTERY VOLTAGE | NULL | NULL | NULL | NULL |
| 7 | DATE/TIME INFORMATION | | | | | | |

DEVICE FOR MOTOR-DRIVEN APPLIANCE

CROSS-REFERENCE TO RELATED APPLICATIONS

This application claims the benefit of Japanese Patent Application No. 2013-097673 filed on May 7, 2013 in the Japan Patent Office, the disclosures of which are incorporated herein by reference.

BACKGROUND

The present invention relates to a device for a motor-driven appliance, which device is a main body of the motor-driven appliance or a peripheral device thereof.

In a conventional motor-driven tool, data of tightening torque and the like is collected when the motor-driven tool is used, and such data is stored in a memory together with date/time information indicating the date and time at which the motor-driven tool was used, for the purpose of traceability management. In this way, the usage history of the motor-driven tool is recorded (see, for example, JP2010-012587).

SUMMARY

According to the above-described motor-driven tool, it is possible, for example, to detect a poor tightening in the product assembled by means of the motor-driven tool, and to identify the point of such a poor tightening, from the history information stored in the memory.

However, the date/time information stored in the memory as part of the history information is obtained from a clock (a timer in a microcomputer, for example) included in the motor-driven tool, and thus, the date/time information itself is discrepant with a proper date and time in some cases.

When the date/time information is discrepant with the proper date and time, reliability of the history information stored in the memory is decreased, and the traceability management cannot be performed successfully.

Such a problem caused by the discrepancy in the date/time information would occur, in a similar manner, not only in the motor-driven tool configured to record history information but also in a motor-driven tool and a motor-driven working machine including a control circuit that performs various controls using date/time information.

Such a problem would also occur, in a similar manner, in a peripheral device (e.g., a power supply device or a battery pack to supply electric power to the motor-driven appliance, and a charger to charge a battery or a battery pack included in the motor-driven appliance) to be connected to the main body of the motor-driven appliance, such as a motor-driven tool and a motor-driven working machine.

In an aspect of the present invention, it is preferable to enable accurate detection of date/time information indicating a current date and time in a device for a motor-driven appliance, which is a main body of the motor-driven appliance or a peripheral device thereof.

A device for a motor-driven appliance of an aspect of the present invention includes a communication unit, a date/time information acquisition unit, and a control unit. The communication unit performs communication with an external appliance having a date/time information indicating a current date and time. The date/time information acquisition unit acquires the date/time information from the external appliance via the communication unit. The control unit performs control based on the date/time information acquired by the date/time information acquisition unit.

Therefore, according to the above-described device for a motor-driven appliance, the control unit can acquire accurate date/time information from the external appliance, regardless of whether the device for a motor-driven appliance includes a measurement unit (a clock, a timer, or the like) that measures a current date and time, and can properly perform control using the date/time information. Thus, according to the present invention, reliability of control by the control unit can be improved.

Next, the device for a motor-driven appliance of another aspect of the present invention may include a measurement unit that measures a current date and time. The control unit may update the current date and time measured by the measurement unit, based on the date/time information acquired by the date/time information acquisition unit.

According to the thus-configured device for a motor-driven appliance, even when there is an error in the date and time measured by the measurement unit, such an error can be corrected based on the date/time information acquired by the date/time information acquisition unit, and reliability of the date and time measured by the measurement unit can thereby be improved.

Even when the date/time information acquisition unit cannot acquire the date/time information from the external appliance via the communication unit, the control unit can perform a predetermined control operation in accordance with the highly reliable date and time measured by the measurement unit, and reliability of control by the control unit can thereby be further improved.

The device for a motor-driven appliance of another aspect of the present invention may include a measurement unit that measures a current date and time. The control unit may generate a difference information indicating a difference between the current date and time measured by the measurement unit and a date and time obtained from the date/time information acquired by the date/time information acquisition unit.

According to the thus-configured device for a motor-driven appliance, when there is an error in the date and time measured by the measurement unit, the difference information is generated based on such an error.

Therefore, even in a case where the date/time information acquisition unit cannot acquire the date/time information from the external appliance via the communication unit, the control unit can accurately detect the current date and time based on the date and time obtained from the measurement unit and the difference information.

Therefore, also in the thus-configured device for a motor-driven appliance, reliability of control by the control unit can be further improved.

For example, in a case where the entirety of the device has stopped operating due to decrease in battery voltage or the like, operation for measurement of the date and time by the measurement unit is also stopped. Thus, according to the thus-configured device for a motor-driven appliance, it is also possible to estimate an operation stop period of the device for a motor-driven appliance from the difference information generated after the device for a motor-driven appliance started operation.

In the device for a motor-driven appliance of another aspect of the present invention, when the device for a motor-driven appliance is connected to other device for a motor-driven appliance, the control unit may provide the date/time information acquired by the date/time information acquisition unit to the other device for a motor-driven appliance.

According to the thus-configured device for a motor-driven appliance, accurate date/time information acquired from the external appliance by the date/time information acquisition unit can be provided to the other device for a motor-driven appliance, and the other device for a motor-driven appliance can perform control based on the provided accurate date/time information.

In a case where the other device for a motor-driven appliance includes the measurement unit that measures a current date and time, the date and time measured by the measurement unit may be made corrected, or a difference information may be made generated based on an error of the date and time measured by the measurement unit.

In the device for a motor-driven appliance of another aspect of the present invention, the communication unit may be communicatable with at least one of a GPS receiver, a standard radio wave receiver, a mobile communication terminal, and a personal computer as the external appliance.

The GPS receiver, the standard radio wave receiver, the mobile communication terminal, and the personal computer (especially, the network-connected one) generally have accurate date/time information.

Therefore, according to the thus-configured device for a motor-driven appliance, it is possible to acquire accurate date/time information from these appliances, and to improve reliability of the date/time information used for control.

The device for a motor-driven appliance of another aspect of the present invention may include a storage unit that stores a history of an operation of the device for a motor-driven appliance. The control unit may associate a history information indicating the history of the operation with the date/time information, and store the history information in the storage unit.

The date/time information associated with the history information and stored in the storage unit corresponds to the accurate date/time information acquired from the external appliance by the date/time information acquisition unit.

Thus, a user of the device for a motor-driven appliance can accurately grasp the history of the operation of the device for a motor-driven appliance together with the date and time of the operation from the history information stored in the storage unit, to thereby enable proper performance of traceability management of a motor-driven appliance system including the device for a motor-driven appliance.

In the device for a motor-driven appliance of another aspect of the present invention, the control unit may count a number of occurrences of the operation corresponding to the history information, and may assign the number of occurrences of the operation to the history information when storing the history information in the storage unit.

The storage unit has a limitation in storage capacity, and thus, old history information is erased due to such a limitation in storage capacity in some cases when latest history information is written. In the device for a motor-driven appliance configured as above, even when the old history information has been erased, the number of occurrences of the operation corresponding to the history information can be detected from the history information stored in the storage unit.

Therefore, according to the thus-configured device for a motor-driven appliance, it can be suppressed that the traceability management of the motor-driven appliance system becomes impossible due to the limitation in storage capacity of the storage unit.

BRIEF DESCRIPTION OF THE DRAWINGS

The present invention will be described below by way of example with reference to accompanying drawings, in which:

FIGS. 4A and 4B are explanatory diagrams showing history information stored in a non-volatile memory of the motor-driven tool;

FIGS. 13A and 13B are explanatory diagrams showing history information stored in a non-volatile memory of the charger;

FIG. 19 is an explanatory diagram showing history information stored in a non-volatile memory of the battery pack;

FIGS. 24A and 24B are explanatory diagrams showing another example of history information stored in the non-volatile memory of the motor-driven tool;

DETAILED DESCRIPTION OF THE PREFERRED EMBODIMENTS

[Configuration of Motor-Driven Tool System]

In the present embodiment, the present invention is applied to a motor-driven tool system. The motor-driven tool system comprises a motor-driven tool 2, a battery pack 4 that supplies electric power to the motor-driven tool 2, and a charger 6 that charges the battery pack 4. The motor-driven tool 2, the battery pack 4, and the charger 6 each function as a device for a motor-driven appliance of the present invention.

Figure 1:
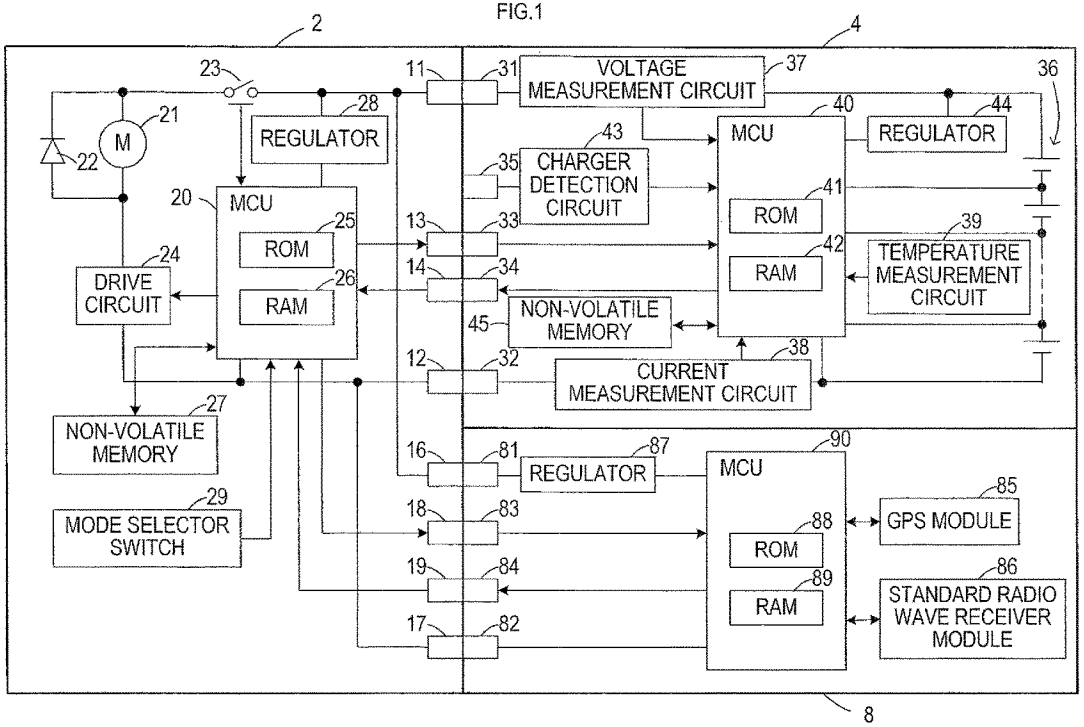
FIG. 1 is a block diagram showing a configuration of a motor-driven tool, a battery pack, and an external appliance according to one embodiment of the present invention.

As shown in FIG. 1, the motor-driven tool 2 of the present embodiment is configured to be able to have the battery pack 4 attached thereto in an attachable and detachable manner, and is operated by receiving power supply from the battery pack 4.

The motor-driven tool 2 includes, as terminals for connection to the battery pack 4, a battery terminal 11, a ground terminal 12, and communication terminals 13 and 14. The motor-driven tool 2 further includes, as a source of power, a drive motor (hereinafter simply referred to as a motor) 21, which is a DC motor.

When the battery pack 4 is attached to the motor-driven tool 2, the battery terminal 11 is connected to a positive side of a battery 36 via a battery terminal 31 of the battery pack 4, and the ground terminal 12 is connected to a negative side of the battery 36 via a ground terminal 32 of the battery pack 4.

In the motor-driven tool 2, the battery terminal 11 is connected to one end of the motor 21 via a trigger switch 23 to be operated by a user, and the ground terminal 12 is connected to the other end of the motor 21 via a drive circuit 24. Connected in parallel to the motor 21 is a diode (so-called flywheel diode) 22 used to regenerate reverse electric power induced when the motor 21 is off.

In the motor-driven tool 2, a regulator 28 and a control circuit 20 are provided. Upon connection of the battery pack 4 to the motor-driven tool 2, the regulator 28 receives power supply from the battery pack 4 to generate a power-supply voltage (DC constant voltage) for driving an internal circuit, regardless of whether the trigger switch 23 is on or off. The control circuit 20 drive-controls the motor 21 by receiving power supply from the regulator 28.

The control circuit 20 includes a microcontroller (MCU) including a CPU, a ROM 25, and a RAM 26. In the ROM 25, a control program and control data for drive-controlling the motor 21 via the drive circuit 24 are stored in advance. The RAM 26 is used for temporary storage of various data.

When drive-controlling the motor 21 via the drive circuit 24, the control circuit 20 communicates with a control circuit 40 in the battery pack 4 via the communication terminals 13 and 14, to thereby import a battery temperature, a battery voltage, and a battery current from the battery pack 4, and utilizes them for control.

To the control circuit 20, a non-volatile memory 27 and a mode selector switch 29 are connected. The non-volatile memory 27 is used to store history information indicating operation history of the motor-driven tool 2. The mode selector switch 29 is used to set a control mode (e.g., high speed or low speed) at the time of driving the motor 21.

The non-volatile memory 27 used in the present embodiment, as well as non-volatile memories 45 and 69 to be described later, comprises an EEPROM or a flash memory, in which data can be rewritten.

The control circuit 20 drive-controls the motor 21 in accordance with the control mode set by the user via the mode selector switch 29 and, when the control mode is switched or when an abnormality is detected, stores history information to that effect in the non-volatile memory 27.

The motor-driven tool 2 further includes terminals 16, 17, 18, and 19 for connection to an external appliance 8.

The terminals 16 and 17 are respectively connected to the battery terminal 11 and the ground terminal 12 to relay power supply from the battery pack 4 to the external appliance 8, and the terminals 18 and 19 are used to connect the control circuit 20 to the external appliance 8 in a communicatable manner.

The control circuit 20 communicates with the external appliance 8 via the terminals 18 and 19, to thereby acquire current date/time information from the external appliance 8.

The external appliance 8 is a mobile communication terminal (e.g., mobile phone, smartphone, and the like) including a GPS module 85 as a GPS receiver and a standard radio wave receiver module 86 as a standard radio wave receiver.

The external appliance 8 can be connected, via terminals 81, 82, 83, and 84, to the motor-driven tool 2 or the charger 6 (see FIG. 2) to be described later.

In the external appliance 8, a regulator 87 and a control circuit 90 are provided. The regulator 87 draws power supplied from the motor-driven tool 2 or the charger 6 via the terminals 81 and 82 to generate a power-supply voltage for driving an internal circuit. The control circuit 90 is operated by receiving the power-supply voltage generated by the regulator 87.

The control circuit 90 comprises an MCU similarly to the control circuit 20 in the motor-driven tool 2, and includes a ROM 88 and a RAM 89. The control circuit 90 communicates with the control circuit 20 in the motor-driven tool 2 or a control circuit 70 (see FIG. 2) in the charger 6 via the terminals 83 and 84, and provides the date/time information indicating the current date and time, which is acquired via the GPS module 85 and the standard radio wave receiver module 86.

In the battery pack 4, communication terminals 33 and 34 are provided in addition to the battery terminal 31 and the ground terminal 32 described above.

When the battery pack 4 is attached to the motor-driven tool 2 or the charger 6, the communication terminals 33 and 34 are respectively connected to the communication terminals 13 and 14 in the motor-driven tool 2 or to communication terminals 53 and 54 (see FIG. 2) in the charger 6.

Accordingly, the control circuit 40 in the battery pack 4 can communicate with the control circuit 20 in the motor-driven tool 2 or the control circuit 70 in the charger 6 via the communication terminals 33 and 34.

In the communication between the control circuit 40 in the battery pack 4 and the control circuit 20 in the motor-driven tool 2 or the control circuit 70 in the charger 6, the battery pack 4 is a slave, and the motor-driven tool 2 or the charger 6 is a master. Thus, the communication is performed under control by the motor-driven tool 2 or the charger 6.

Figure 2:
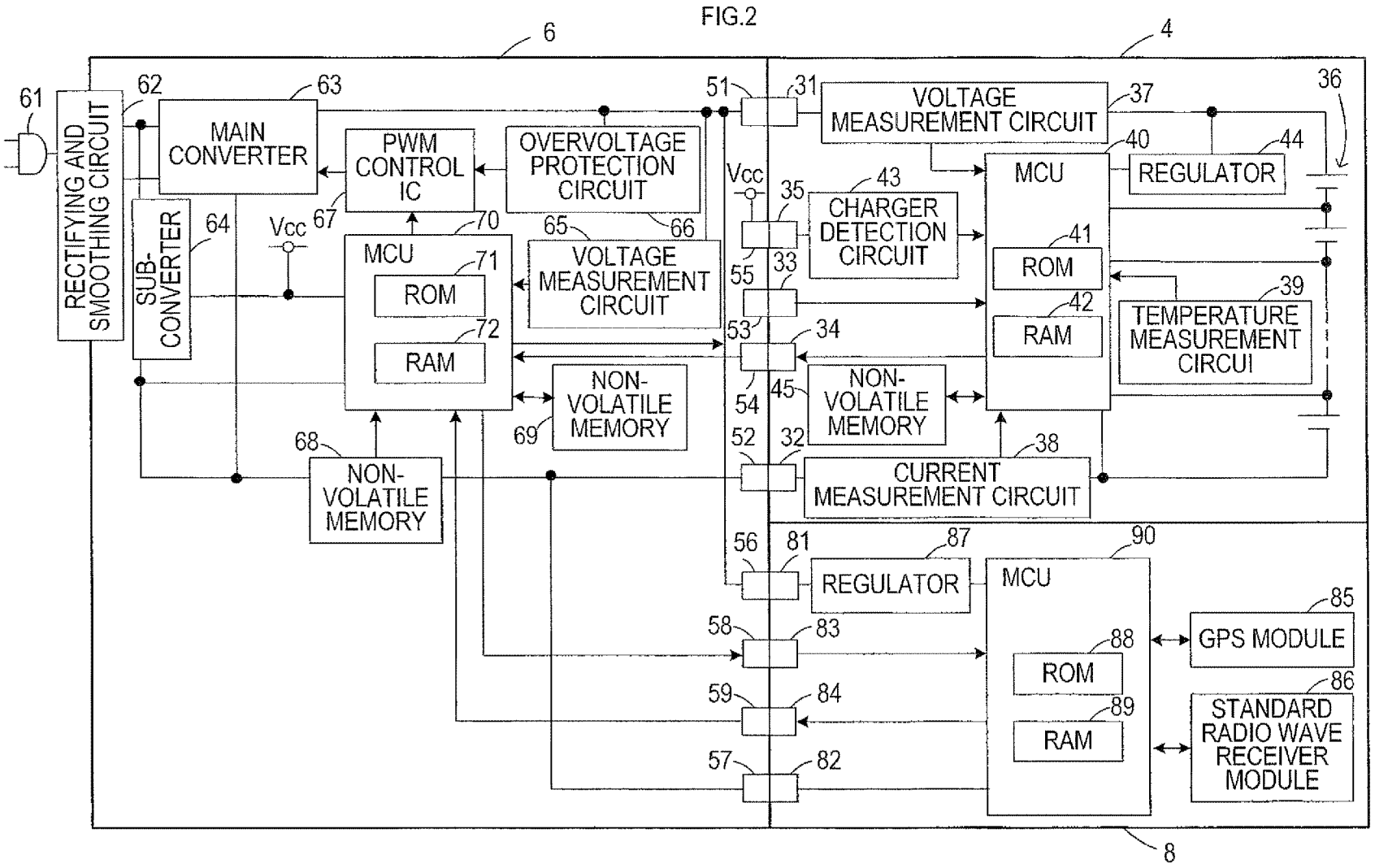
FIG. 2 is a block diagram showing a configuration of a charger connected to the battery pack in FIG. 1.

The battery pack 4 is designed, when attached to the charger 6 shown in FIG. 2, to be able to have the battery 36 charged by the charger 6, by connection of the battery terminal 31 and the ground terminal 32 to a battery terminal 51 and a ground terminal 52, respectively, on the part of the charger 6.

Provided in the battery pack 4 is a power-supply terminal 35, which is connected to a power-supply terminal 55 in the charger 6 when the battery pack 4 is attached to the charger 6, and via which a power-supply voltage Vcc is supplied from the charger 6. To the power-supply terminal 35, a charger detection circuit 43 is connected that detects, by the voltage supplied from the charger 6, that the battery pack 4 has been attached to the charger 6.

In the battery pack 4, a voltage measurement circuit 37 that measures a battery voltage is provided in a power-supply line connecting the positive side of the battery 36 and the battery terminal 31. In a ground line connecting the negative side of the battery 36 and the ground terminal 32, a current measurement circuit 38 is provided that detects a battery current flowing through the battery 36 (specifically, a charging current to the battery 36 and a discharge current from the battery 36).

The battery pack 4 further includes a temperature measurement circuit 39, a regulator 44, and the non-volatile memory 45. The temperature measurement circuit 39 detects a temperature of the battery 36. The regulator 44 generates a power-supply voltage (DC constant voltage) for driving an internal circuit by receiving power supply from the battery 36.

The control circuit 40 in the battery pack 4 comprises an MCU similarly to the control circuit 20 in the motor-driven tool 2 and the control circuit 90 in the external appliance 8, and includes a ROM 41 and a RAM 42.

When start of driving the motor 21 is notified from the motor-driven tool 2 via the communication terminals 33 and 34, the control circuit 40 detects a battery voltage, a battery current, and a battery temperature via the voltage measurement circuit 37, the current measurement circuit 38, and the temperature measurement circuit 39, respectively, and notifies detection results to the control circuit 20 in the motor-driven tool 2.

The control circuit 40 also detects a battery voltage, a battery current, and a battery temperature via the respective measurement circuits 37 to 39 when detecting that the battery pack 4 is attached to the charger 6 via the charger detection circuit 43, and notifies detection results in accordance with a request from the control circuit 70 in the charger 6.

While being active, the control circuit 40 monitors operation of the battery pack 4, and stores operation history, which is a monitoring result, in the non-volatile memory 45 as history information.

As shown in FIG. 2, provided in the charger 6 are the battery terminal 51, the ground terminal 52, the communication terminals 53 and 54, and the power-supply terminal 55, which are respectively connected to the battery terminal 31, the ground terminal 32, the communication terminals 33 and 34, and the power-supply terminal 35 in the battery pack 4 when the battery pack 4 is attached to the charger 6.

Further provided in the charger 6 are a rectifying and smoothing circuit 62, a main converter 63, and a sub-converter 64. The rectifying and smoothing circuit 62 rectifies and smoothes an AC voltage inputted from a commercial power source via a power-supply plug 61. By an output from the rectifying and smoothing circuit 62, the main converter 63 and the sub-converter 64 respectively generate a charging voltage to the battery 36 and the power-supply voltage (DC constant voltage) Vcc for driving an internal circuit.

The power-supply voltage Vcc generated by the sub-converter 64 is supplied to the internal circuit in the charger 6, including the control circuit 70, and is also outputted further to the battery pack 4 via a power-supply terminal 55.

An output of the main converter 63 is connected to the battery terminal 51, and in the connection path (in other words, in a positive-side charging path to the battery 36), a voltage measurement circuit 65 that measures a charging voltage and an overvoltage protection circuit 66 are provided.

The overvoltage protection circuit 66 is used to stop charging to the battery 36 by outputting a stop command to a PWM control IC 67 that PWM-controls a switching element in the main converter 63 when the charging voltage has become excessively large.

In a negative-side charging path extending from the ground terminal 52 toward the main converter 63 and the sub-converter 64, a current measurement circuit 68 is provided. Results measured by the current measurement circuit 68 and the voltage measurement circuit 65 are inputted into the control circuit 70.

The control circuit 70 comprises an MCU similarly to the control circuit 20 in the motor-driven tool 2 and the control circuit 40 in the battery pack 4, and includes a ROM 71 and a RAM 72.

The control circuit 70 imports status information (a battery temperature and the like) of the battery 36 from the battery pack 4 via the communication terminals 53 and 54, and sets parameters (driving duty and the like) for control of the main converter 63 by the PWM control IC 67, based on the imported battery status information, the charging current detected by the current measurement circuit 63, and the charging voltage detected by the voltage measurement circuit 65.

To the control circuit 70, the non-volatile memory 69 is connected that is used to store history information indicating operation history of the charger 6, and the control circuit 70 stores, as history information, various pieces of operation history, such as charging operation to the battery 36, in the non-volatile memory 69.

The charger 6 is provided with terminals 56, 57, 53, and 59 for connection to the external appliance 8.

The terminals 56 and 57 are respectively connected to the battery terminal 51 and the ground terminal 52, so that the charging voltage to be supplied to the battery pack 4 can also be supplied to the external appliance 8. The terminals 58 and 59 are used for communicatable connection of the control circuit 70 to the external appliance 8.

The control circuit 70 acquires current date/time information from the external appliance 8 by communicating with the external appliance 8 via the terminals 58 and 59.

As explained hereinabove, in the motor-driven tool 2, the battery pack 4, and the charger 6, the control circuits 20, 40, and 70 respectively perform drive control of the motor 21, charging/discharging control (specifically, status monitoring at the time of battery charging/discharging) of the battery 36, and charging control of the battery 36, respectively.

The control circuits 20, 40, and 70 each monitor the operational state of the respective devices (the motor-driven tool 2, the battery pack 4, and the charger 6, respectively) when performing control processes for the above-described respective controls. Then, when the operational state has changed or an abnormality has occurred, the control circuits 20, 40, and 70 each determine that an event that should be recorded as history has occurred, and store history information to that effect in the non-volatile memories 27, 45, and 69, respectively.

When storing the history information in the non-volatile memories 27, 45, and 69, respectively, the control circuits 20, 40, and 70 each assign, to the history information, date/time information indicating the date and time at which the operation corresponding to the history information occurred.

If the date/time information is incorrect, traceability management of the respective devices cannot be performed accurately. Thus, the control circuits 20, 40, and 70 each acquire the date/time information from the external appliance 8. Since the battery pack 4 cannot be directly connected to the external appliance 8, the date/time information is acquired from the external appliance 8 via the motor-driven tool 2 or the charger 6.

Next, an explanation will be given below about control processes performed by the control circuits 20, 40, and 70 respectively in the motor-driven tool 2, the battery pack 4, and the charger 6.

[Control Process by the Control Circuit 20 in the Motor-Driven Tool 2]

Figure 3:
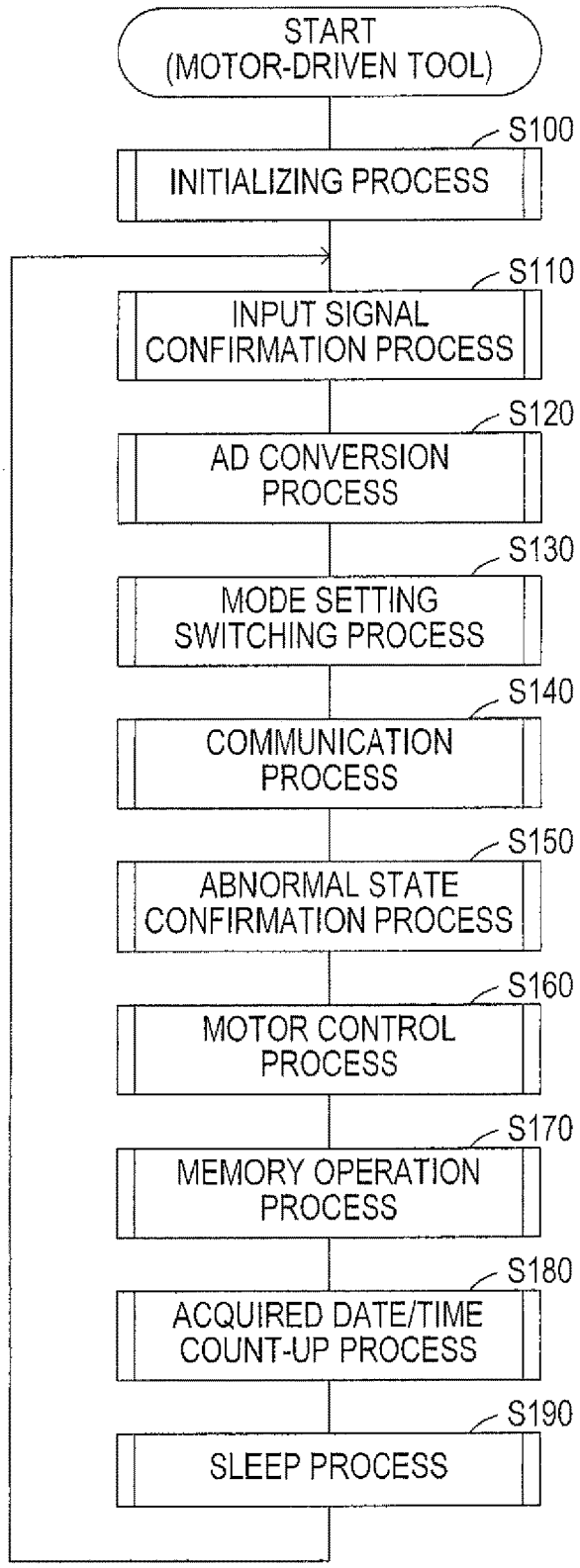
FIG. 3 is a flowchart showing a control process performed by a control circuit of the motor-driven tool.

As shown in FIG. 3, when power is applied from the regulator 28 to start a control process, the control circuit 20 in the motor-driven tool 2 performs an initializing process, in S100 (S represents a step), that initializes various parameters and various flags to be described later, which are used for drive-control of the motor 21.

In this initializing process, the control circuit 20 reads the number of detections of abnormal states to be stored as operation history of the motor-driven tool 2 from the history information currently stored in the non-volatile memory 27 in order to generate new history information and write the new history information into the non-volatile memory 27 in a process to be described later.

Specifically, the motor-driven tool 2 is designed to store history information indicating Memory Contents 1 to 6 shown in FIGS. 4A and 4B in the non-volatile memory 27 when the control circuit 20 shifts to a sleep state, when a battery voltage is decreased, when the motor 21 is in an overload operational state, when the motor 21 is overheated, when the battery 36 is in an abnormal state, and when a control mode is switched, respectively.

When the control circuit 20 shifts to a sleep state, stored in the non-volatile memory 27 as history information is a data (Memory Content 1) composed of number-of-times information "1" indicating number of past detections of decrease in battery voltage, overload of the motor 21, overheat (high temperature) of the motor 21, and battery abnormality; and date/time information "7" assigned thereto.

The number-of-times information "1" is stored in the non-volatile memory 27 as history information also when decrease in voltage is detected, when overload is detected, when high temperature is detected, when battery abnormality is detected, and when a control mode is switched.

The purpose of this is to make it possible to detect the content and occurrence number of past abnormalities from the latest history information, even if the past history information has been erased due to capacity shortage of the non-volatile memory 27 when history information is written into the non-volatile memory 27.

Therefore, in the initializing process in S100, the control circuit 20 reads the number of detections of the above-described respective abnormal states from the latest history information stored in the non-volatile memory 27. The control circuit 20 is designed to thereby update the number of detections later when the above-described respective abnormal states are detected, and to store the history information, to which the updated number of detections is assigned, in the non-volatile memory 27.

The history information to be stored in the non-volatile memory 27 when decrease in voltage is detected, when overload is detected, when high temperature is detected, when battery abnormality is detected, and when a control mode is switched is as described in FIGS. 4A and 4B as Memory Contents 2 to 6, respectively.

Specifically, when decrease in voltage is detected, stored in the non-volatile memory 27 as history information is a data (Memory Content 2) composed of information "2" indicating a control mode, motor driving time, and a battery voltage at that time; and the number-of-times information "1" and the date/time information. "7" assigned thereto.

When overload is detected, stored in the non-volatile memory 27 as history information is a data (Memory Content 3) composed of information "3" indicating a control mode, a current distribution, and motor driving time at that time; and the number-of-times information "1" and the date/time information "7" assigned thereto.

When high temperature is detected, similarly to the information "3" at the time of detecting overload, stored in the non-volatile memory 27 as history information is a data (Memory Content 4) composed of information "4" indicating a control mode, current distribution, and motor driving time at that time; and the number-of-times information "1" and the date/time information "7" assigned thereto.

When battery abnormality is detected, stored in the non-volatile memory 27 as history information is a data (Memory Content 5) composed of information "5" indicating a control mode, a temperature of a controller (i.e., the control circuit 20), status information of the battery 36, and a current distribution at that time; and the number-of-times information "1" and the date/time information "7" assigned thereto.

When a control mode is switched, stored in the non-volatile memory 27 as history information is a data (Memory Content 6) composed of information "6" indicating a control mode, a temperature of the controller, and a battery voltage after the control mode is switched; and the number-of-times information "1" and the date/time information "7" assigned thereto.

Next, in S110, the control circuit 20 confirms switch signals from the trigger switch 23, the mode selector switch 29, a rotational direction selector switch (not shown), and the like. In subsequent S120, the control circuit 20 imports AD conversion values of a battery voltage, a temperature of the controller, a motor current, a pull amount of the trigger switch 23, and the like.

In S130, the control circuit 20 performs a mode setting switching process that sets a control mode based on a switching state of the mode selector switch 29. In subsequent S140, the control circuit 20 performs a communication process that communicates with the external appliance 8 and the battery pack 4.

In S150, the control circuit 20 performs an abnormal state confirmation process that confirms an abnormal state of the above-described battery voltage and the like. In S160, the control circuit 20 performs a motor control process that drive-controls the motor 21.

In the motor control process, when an abnormality is detected in the abnormal state confirmation process, the control circuit 20 stops driving the motor 21, and then, keeps a drive stop state until an operation of the trigger switch 23 by the user is ended.

Next, in S170, the control circuit 20 performs a memory operation process that writes history information into the non-volatile memory 27. In subsequent S180, the control circuit 20 performs an acquired date/time count-up process that updates (counts up) the current date and time based on the date/time information acquired from the external appliance 8.

Lastly, in S190, the control circuit 20 performs a sleep process, in which the control circuit 20 shifts to a sleep state when a state in which switching operation of the trigger switch 23 and the like is not found has continued for a predetermined period of time or longer and wakes up when switching operation of the trigger switch 23 and the like is found after such shifting to a sleep state.

After the sleep process is performed, the process proceeds to S110 again. In this way, the control circuit 20 repeatedly performs the above-described series of processes.

Next, an explanation will be given below about a process related to writing of history information into the non-volatile memory 27, from among the above-descried series of processes.

Figure 5:
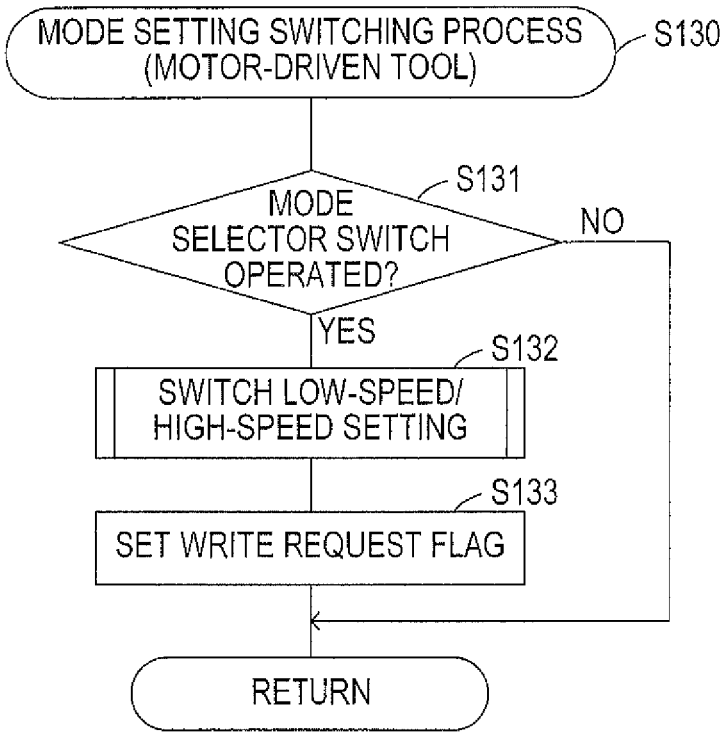
FIG. 5 is a flowchart showing a mode setting switching process shown in FIG. 3.

As shown in FIG. 5, in the mode setting switching process in S130, the control circuit 20 first determines in S131 whether the mode selector switch 29 has been operated by the user.

If the mode selector switch 29 has not been operated, the control circuit 20 terminates the mode setting switching process. If the mode selector switch 29 has been operated, the process proceeds to S132, and the control circuit 20 switches a setting of a control mode of the motor 21 to high speed or low speed.

After switching the control mode, the control circuit 20 sets a write request flag in S133 in order to record such a switching operation as operation history, and terminates the mode setting switching process.

Figure 6A:
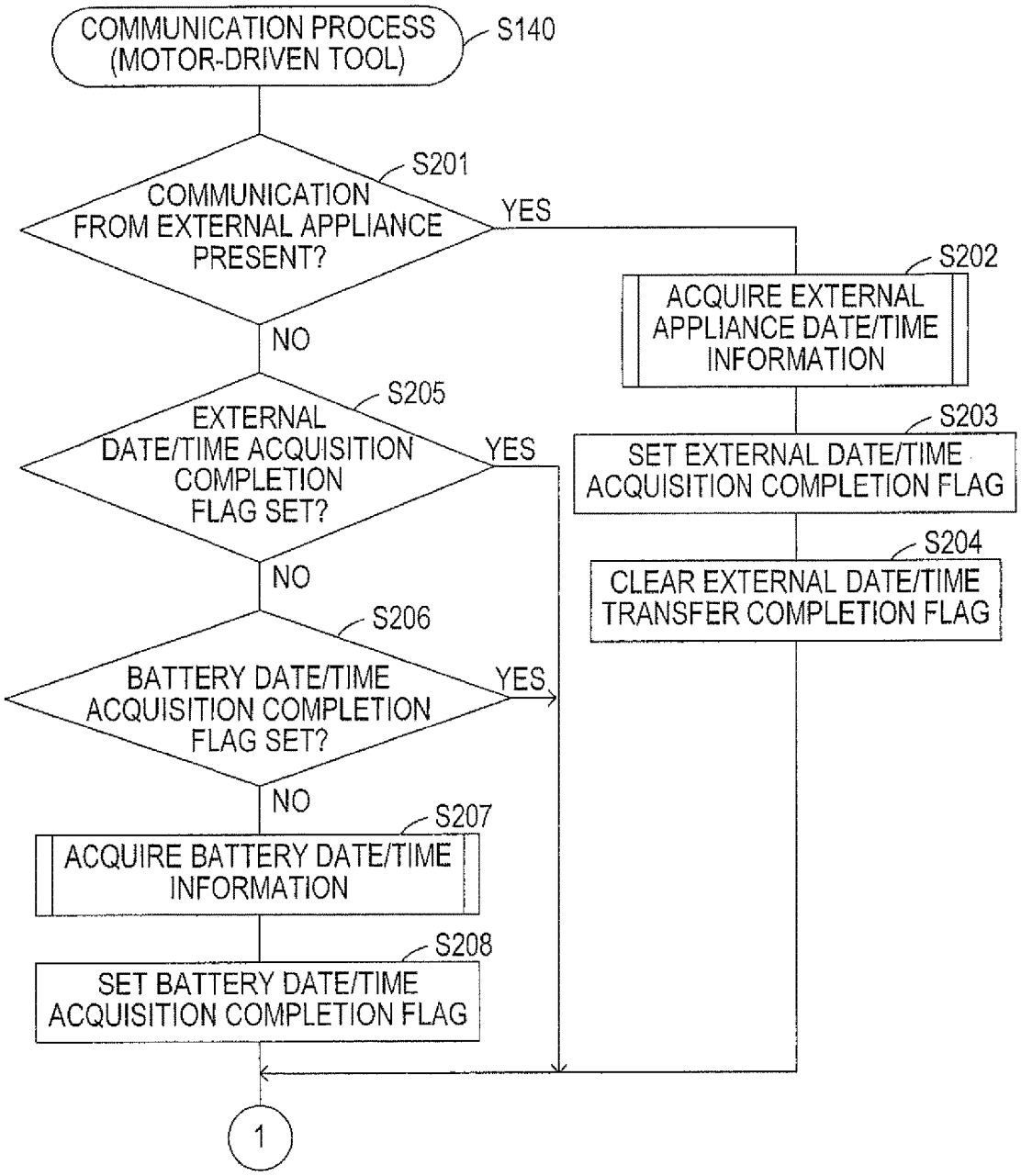
FIGS. 6A and 6B are flowcharts showing a communication process shown in FIG. 3.
Figure 6B:
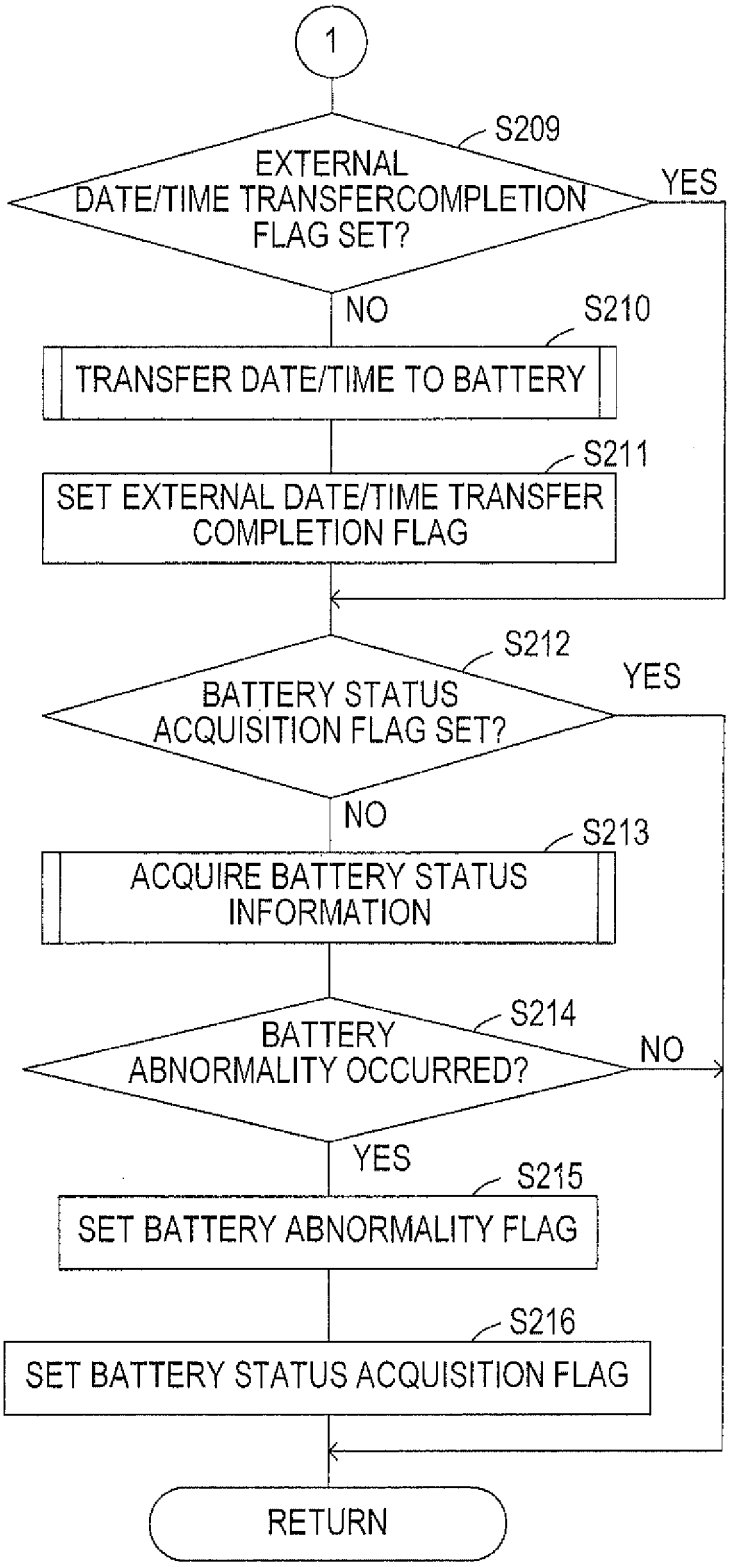

Next, as shown in FIGS. 6A and 6B, in the communication process in S140, the control circuit 20 first determines in S201 whether there has been a communication from the external appliance 8.

If there has been a communication from the external appliance 8, the process proceeds to S202, and the control circuit 20 acquires current date/time information from data transmitted from the external appliance 8, and sets an external date/time acquisition completion flag in S203. In subsequent S204, the control circuit 20 clears an external date/time transfer completion flag. Then, the process proceeds to S209.

The external date/time transfer completion flag is a flag indicating whether the date/time information acquired from the external appliance 8 has been notified to the battery pack 4. If this flag has been cleared, such clearance indicates that transfer of the date/time information is not completed.

Next, when it is determined in S201 that there has been no communication from the external appliance 8, the process proceeds to S205, and the control circuit 20 determines whether the external date/time acquisition completion flag is set.

If the external date/time acquisition completion flag is set, the date/time information has been already acquired from the external appliance 8 and, thus, the process proceeds to S209. If the external date/time acquisition completion flag is not set, the process proceeds to S206.

In S206, the control circuit 20 determines whether a battery date/time acquisition completion flag is set to thereby determine whether the date/time information has been acquired from the battery pack 4. If the battery date/time acquisition completion flag is set, the date/time information has been acquired from the battery pack 4 and, thus, the process proceeds to S209.

If the battery date/time acquisition completion flag is not set, the date/time information has not been acquired either from the external appliance 8 or from the battery pack 4. Therefore, the process proceeds to S207, and the control circuit 20 requests the date/time information from the battery pack 4, to thereby acquire the current date/time information from the battery pack 4.

In subsequent S208, the control circuit 20 sets the battery date/time acquisition completion flag, and the process proceeds to S209.

The reason why the control circuit 20 acquires the date/time information from the battery pack 4 when the date/time information has not been acquired from the external appliance 8 is that, in the battery pack 4, the control circuit 40 performs measurement of date and time by receiving power supply from the battery 36 as long as the battery 36 is not in a discharged state.

In short, since the motor-driven tool 2 completely stops operation and cannot measure date and time if the battery pack 4 is not attached thereto, the motor-driven tool 2 is designed to be able to acquire the date/time information at least from the battery pack 4 immediately after the battery pack 4 is attached thereto and the control circuit 20 is activated.

Next, in S209, the control circuit 20 determines whether the external date/time transfer completion flag is set. If the external date/time transfer completion flag is set, the process proceeds to S212. If the external date/time transfer completion flag is not set, the process proceeds to S210.

In S210, the control circuit 20 notifies the current date/time information based on the date/time information acquired from the external appliance 8 to the battery pack 4, to thereby update the date/time information measured in the battery pack 4 to accurate date/time information. Subsequently, the control circuit 20 sets the external date/time transfer completion flag in S211, and the process proceeds to S212.

In S212, the control circuit 20 determines whether a battery status acquisition flag is set, which is to be set in the subsequent process, when battery status information indicating a battery status such as a battery temperature and a battery voltage is acquired from the battery pack 4. If the battery status acquisition flag is not set, the process proceeds to S213.

In S213, the control circuit 20 requests the battery status information from the battery pack 4, to thereby acquire battery status information from the battery pack 4. In subsequent S214, the control circuit 20 determines whether there occurs an abnormality in the battery 36 based on the acquired battery status information. If there occurs an abnormality in the battery 36, the process proceeds to S215, and the control circuit 20 sets a battery abnormality flag. Then, the process proceeds to S216. In S216, the control circuit 20 sets the battery status acquisition flag, and terminates the communication process.

If it is determined in S214 that there occurs no abnormality in the battery 36, the communication process is terminated.

In a case also where it is determined in S212 that the battery status acquisition flag is set, the communication process is terminated.

Figure 7:
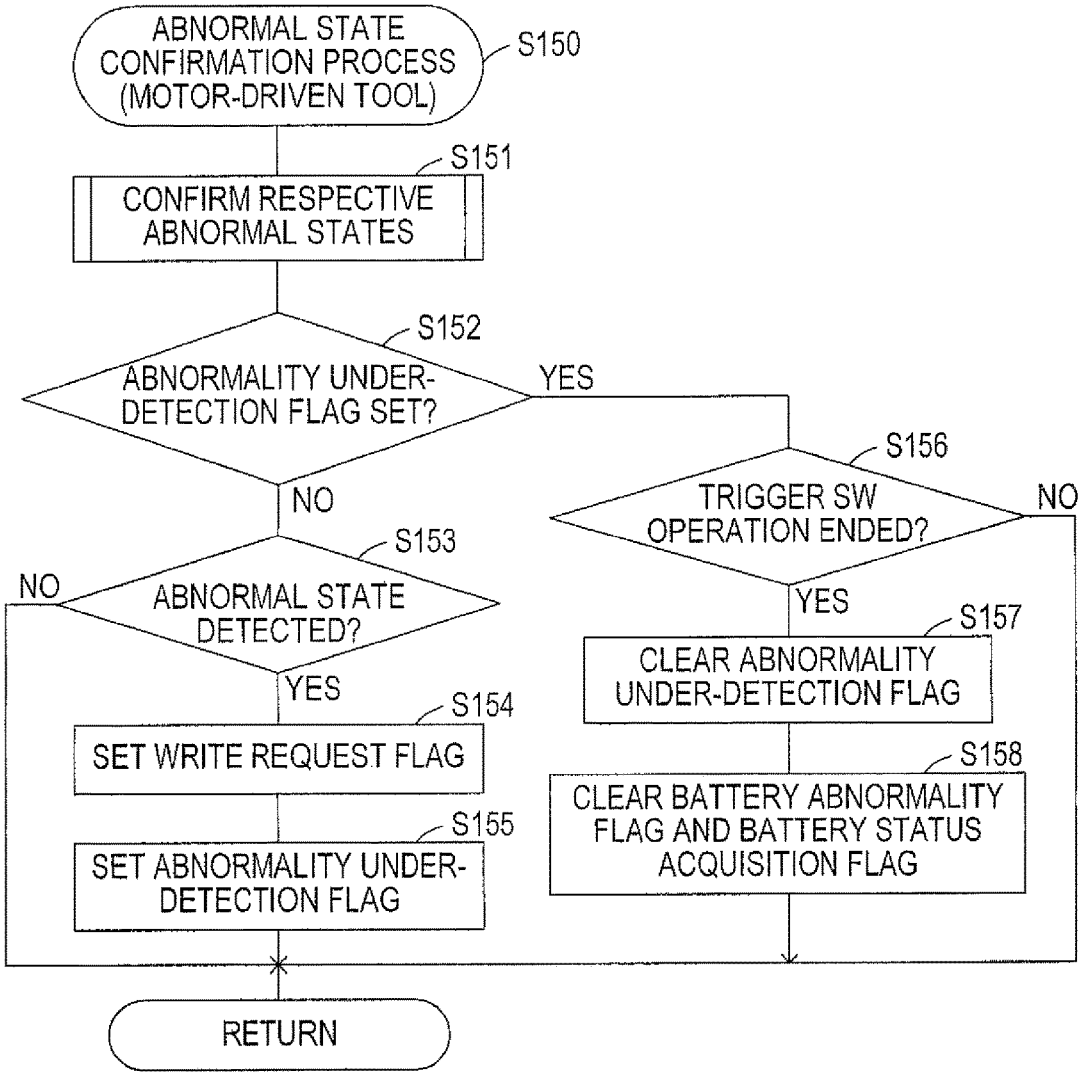
FIG. 7 is a flowchart showing an abnormal state confirmation process shown in FIG. 3.

Next, as shown in FIG. 7, in the abnormal state confirmation process in S150, the control circuit 20 first confirms in S151 whether an abnormal state such as the above-described decrease in voltage, overload, high temperature, and battery abnormality has occurred, and the process proceeds to S152.

In S152, the control circuit 20 determines whether an abnormality under-detection flag is set. If the abnormality under-detection flag is not set, the control circuit 20 determines in S153 whether any abnormal state has been detected in S151.

If it is determined in S153 that an abnormal state has been detected, the process proceeds to S154 in order to record the detected abnormal state as operation history of the motor-driven tool 2, and the control circuit 20 sets the write request flag. In subsequent S155, the control circuit 20 sets the abnormality under-detection flag.

Upon determining that no abnormal state has been detected in S153, or upon setting the abnormality under-detection flag in S155, the control circuit 20 terminates the abnormal state confirmation process.

In contrast, if it is determined in S152 that the abnormality under-detection flag is set, the process proceeds to S156, and the control circuit 20 determines whether the operation of the trigger switch 23 by the user has been ended.

If the operation of the trigger switch 23 has not been ended, the control circuit 20 terminates the abnormal state confirmation process. If the operation of the trigger switch 23 has been ended, the control circuit 20 clears the abnormality under-detection flag in S157. Then, the control circuit 20 clears the battery abnormality flag and the battery status acquisition flag in S158, and terminates the abnormality confirmation process.

The reason why the control circuit 20 clears the above-described respective flags as described above when the operation of the trigger switch 23 by the user has been ended is that, when the operation of the trigger switch 23 by the user is once ended and the trigger switch 23 is operated later, the motor 21 is driven in the motor control process in S160.

In other words, in the present embodiment, it is designed such that, by clearing the above-described respective flags when the operation of the trigger switch 23 has been ended, detection of an abnormal state can be performed also at the time of next motor driving.

Moreover, in the present embodiment, since the write request flag is set when an abnormal state is detected, every time an abnormal state is detected, history information to that effect is to be stored in the non-volatile memory 27 together with the number of detections.

Figure 8:
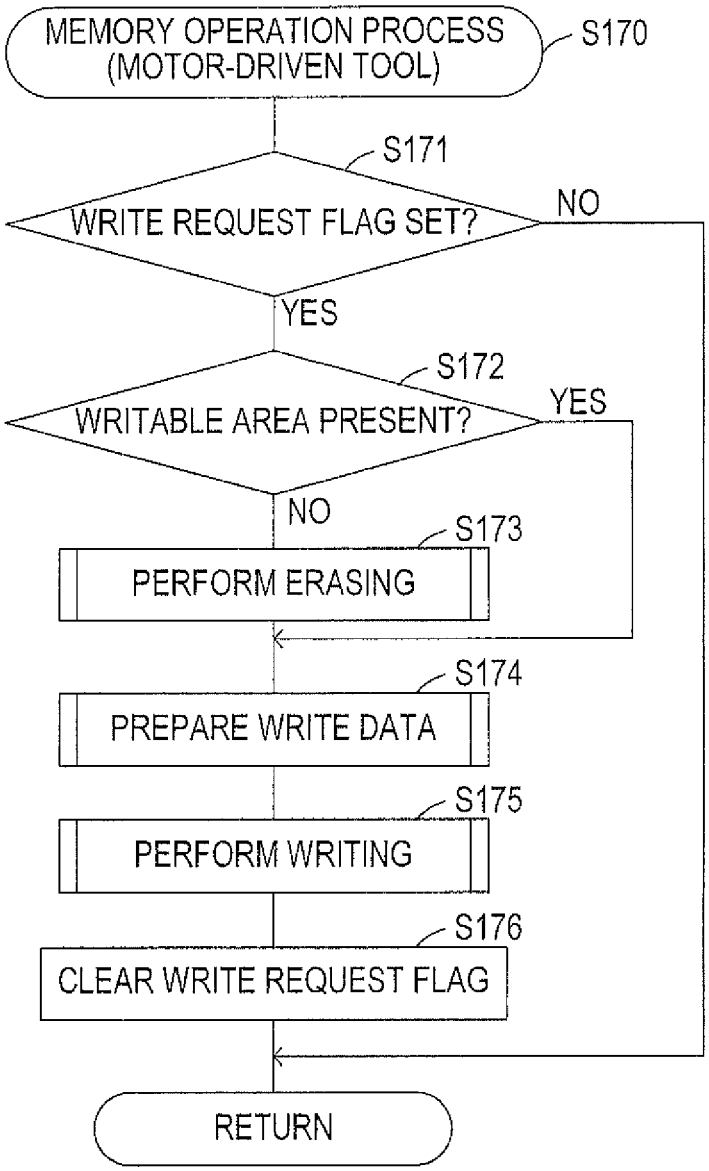
FIG. 8 is a flowchart showing a memory operation process shown in FIG. 3.

Next, as shown in FIG. 8, in the memory operation process in S170, the control circuit 20 first determines in S171 whether the write request flag is set.

If the write request flag is not set, the control circuit 20 terminates the memory operation process. If the write request flag is set, the process proceeds to S172, and the control circuit 20 determines whether the non-volatile memory 27 has an area (writable area) into which new history information can be written.

If the non-volatile memory 27 has no writable area for history information, the control circuit 20 erases all or part of the data stored in a storage area of the non-volatile memory 27 in S173, and the process proceeds to S174. If the non-volatile memory 27 has a writable area, the process proceeds directly to S174.

In S174, the control circuit 20 prepares a write data for writing history information into the non-volatile memory 27, and in S175, the control circuit 20 stores the prepared write data (i.e., history information) in the non-volatile memory 27. Lastly, the control circuit 20 clears the write request flag in S176, and terminates the memory operation process.

Figure 9:
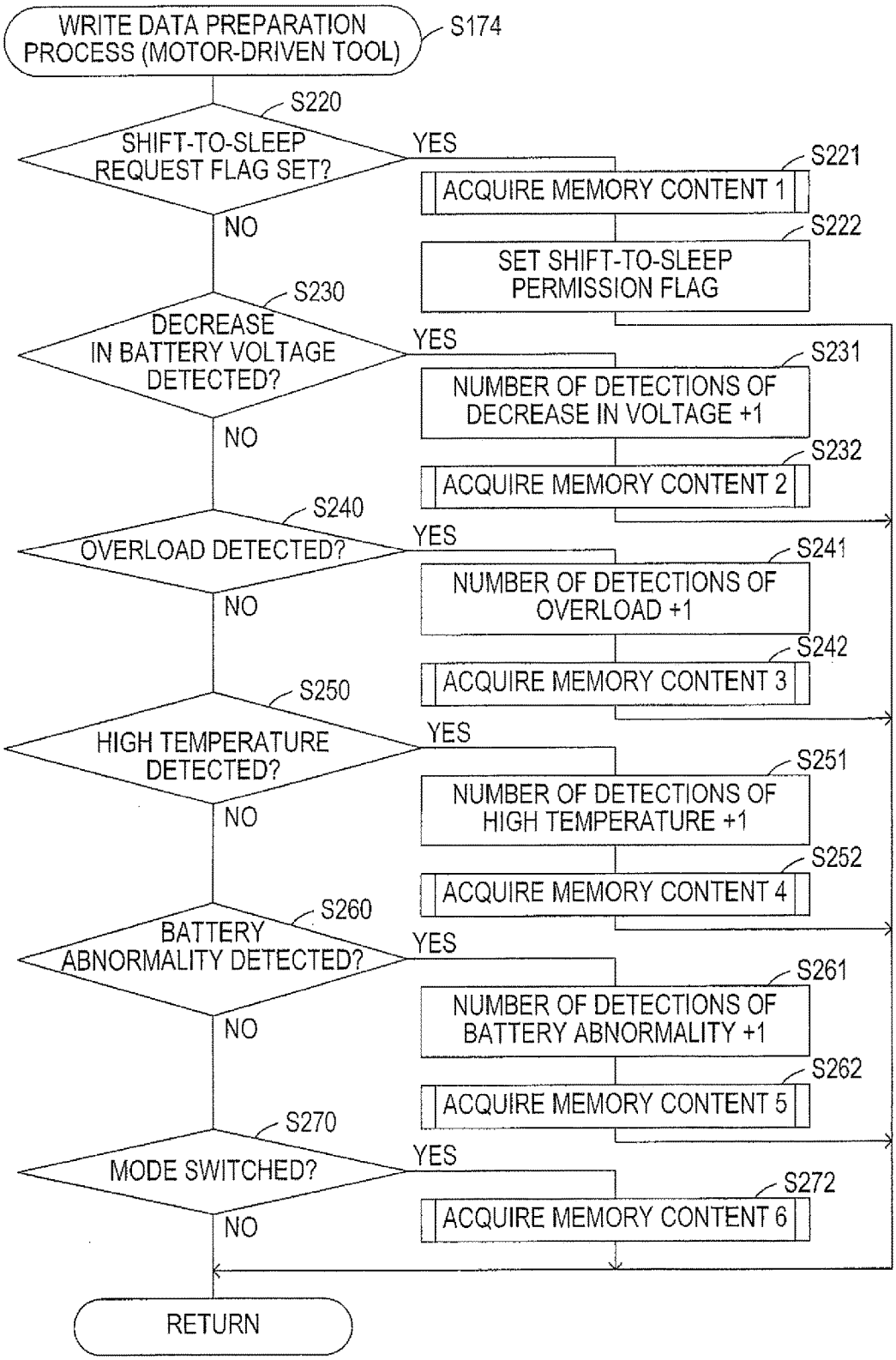
FIG. 9 is a flowchart showing a write data preparation process shown in FIG. 8.

Here, a write data preparation process in S174 is performed through procedures shown in FIG. 9.

Specifically, in the write data preparation process, the control circuit 20 first determines in S220 whether a shift-to-sleep request flag is set, which is to be set at the time of shifting to a sleep state in the sleep process in S190.

If the shift-to-sleep request flag is set, the process proceeds to S221, and the control circuit 20 acquires latest values of various pieces of information (number of decreases in voltage, number of detections of overload, number of detections of high temperature, number of detections of battery abnormality, date/time information indicating the current date and time) constituting Memory Content 1 shown in FIG. 4A, and sets a shift-to-sleep permission flag in S222. Then, the control circuit 20 terminates the write data preparation process.

If it is determined in S220 that the shift-to-sleep request flag is not set, the control circuit 20 determines in S230 whether decrease in battery voltage has been detected in the abnormal state confirmation process in S150.

If decrease in battery voltage has been detected, the process proceeds to S231, and the control circuit 20 increments (+1) the number of detections of decrease in voltage. Then, in subsequent 3232, the control circuit 20 acquires updated values of various pieces of information (mode setting, motor drive time, battery voltage, date/time information, and number of detections of respective abnormal states) constituting Memory Content 2 shown in FIG. 4A, and terminates the write data preparation process.

If it is determined in S230 that no decrease in battery voltage has been detected, the process proceeds to S240, and the control circuit 20 determines whether overload operation of the motor 21 has been detected in the abnormal state confirmation process in S150.

If overload operation of the motor 21 has been detected, the process proceeds to S241, and the control circuit 20 increments (+1) the number of detections of overload. Then, in subsequent S242, the control circuit 20 acquires latest values of various pieces of information (mode setting, current distribution, motor drive time, date/time information, and number of detections of respective abnormal states) constituting Memory Content 3 shown in FIG. 4A, and terminates the write data preparation process.

If it is determined in S240 that no overload operation of the motor 21 has been detected, the process proceeds to S250, and the control circuit 20 determines whether overheat (high temperature) of the motor 21 has been detected in the abnormal state confirmation process in S150.

If overheat (high temperature) of the motor 21 has been detected, the process proceeds to S251, and the control circuit 20 increments (+1) the number of detections of high temperature. Then, in subsequent S252, the control circuit 20 acquires latest values of various pieces of information (mode setting, current distribution, motor drive time, date/time information, and number of detections of respective abnormal states) constituting Memory Content 4 shown in FIG. 4B, and terminates the write data preparation process.

If it is determined in S250 that no overheat (high temperature) of the motor 21 has been detected, the process proceeds to S260, and the control circuit 20 determines whether battery abnormality has been detected in the abnormal state confirmation process in S150.

If battery abnormality has been detected, the process proceeds to S261, and the control circuit 20 increments (+1) the number of detections of battery abnormality. Then, in subsequent S262, the control circuit 20 acquires latest values of various pieces of information (mode setting, controller temperature, battery status information, current distribution, date/time information, and number of detections of respective abnormal states) constituting Memory Content 5 shown in FIG. 4B, and terminates the write data preparation process.

If it is determined in S260 that no battery abnormality has been detected, the process proceeds to S270, and the control circuit 20 determines whether control mode switching has been performed in the mode setting switching process in S130.

If control mode switching has been performed, the process proceeds to S272. In S272, the control circuit 20 acquires latest values of various pieces of information (mode setting, controller temperature, battery voltage, date/time information, and number of detections of respective abnormal states) constituting Memory Content 6 shown in FIG. 4B, and terminates the write data preparation process. In a case also where it is determined in S270 that control mode switching has not been performed, the control circuit 20 terminates the write data preparation process.

As described above, in the memory operation process in S170, when the write request flag is set, the control circuit 20 performs the write data preparation process in S174, to thereby collect various pieces of information constituting history information (Memory Contents 1 to 6 shown in FIGS. 4A and 4B) that should be written into the non-volatile memory 27. Then, in subsequent S175, the control circuit 20 generates history information based on the collected various pieces of information, and stores the generated history information in the non-volatile memory 27.

Figure 10:
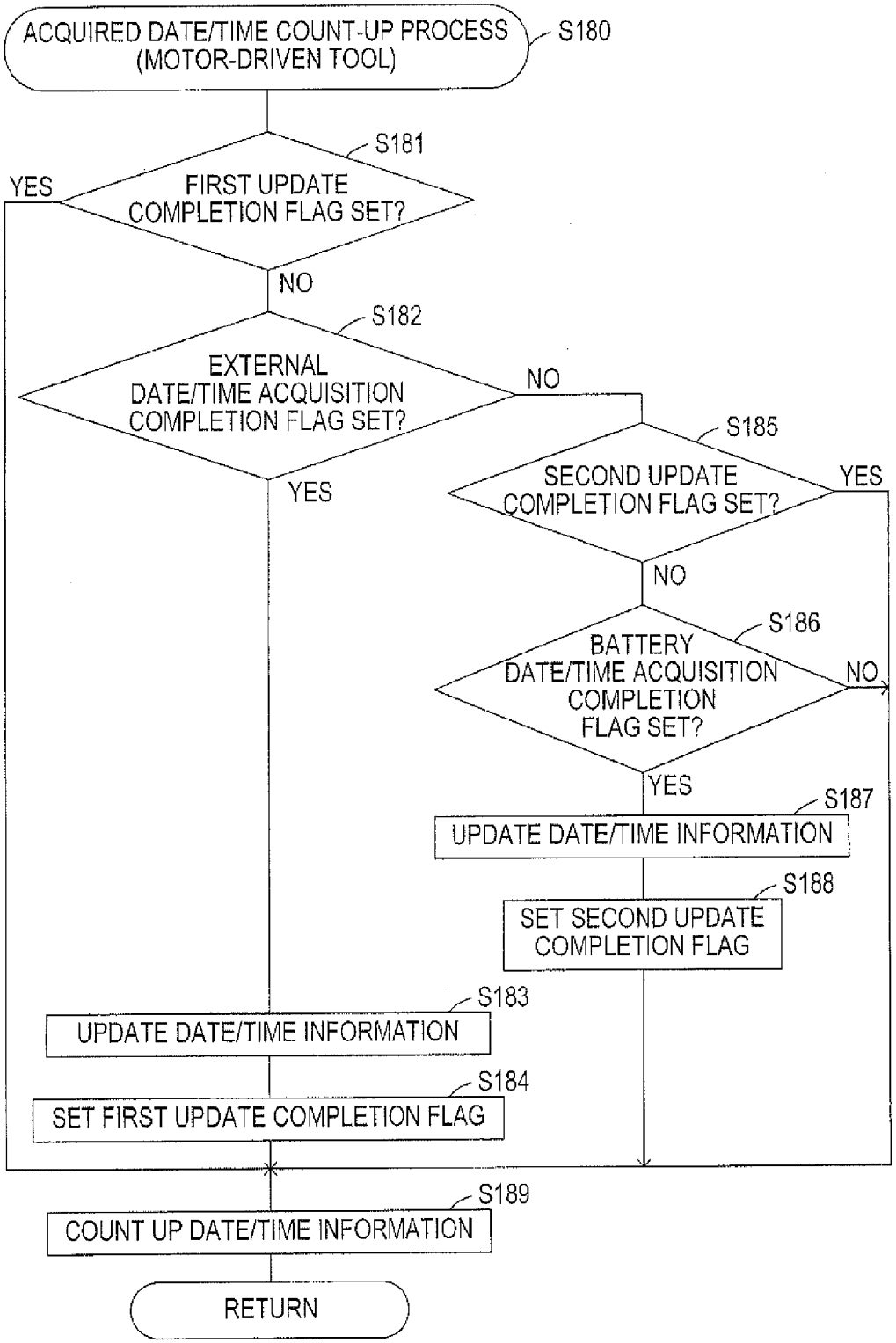
FIG. 10 is a flowchart showing an acquired date/time count-up process shown in FIG. 3.

Next, as shown in FIG. 10, in an acquired date/time count-up process in S180, the control circuit 20 first determines in S181 whether a first update completion flag is set.

If the first update completion flag is not set, the process proceeds to S182, and the control circuit 20 determines whether the external date/time acquisition completion flag is set, which is to be set when the date/time information is acquired from the external appliance 8 in the communication process in S140.

If it is determined in S182 that the external date/time acquisition completion flag is set, the process proceeds to S183. In S183, the control circuit 20 updates the current date/time information recognized by the control circuit 20 into the latest date/time information acquired from the external appliance 8, and the process proceeds to S184.

The control circuit 20 sets the first update completion flag in S184, and in subsequent S189, counts up the date/time information updated in S184, to thereby update the current date/time information. Then, the control circuit 20 terminates the acquired date/time count-up process.

The count-up of the date/time information in S189 is also performed in a case where it is determined in S181 that the first update completion flag is set.

If it is determined in S182 that the external date/time acquisition completion flag is not set, the process proceeds to S185, and the control circuit 20 determines whether a second update completion flag is set.

If it is determined in S185 that the second update completion flag is not set, the process proceeds to S186, and the control circuit 20 determines whether the battery date/time acquisition completion flag is set, which is to be set when the date/time information is acquired from the battery pack 4 in the communication process in S140.

If it is determined in S186 that the battery date/time acquisition completion flag is set, the process proceeds to S187. In S187, the control circuit 20 updates the current date/time information recognized by the control circuit 20 into the latest date/time information acquired from the battery pack 4, and the process proceeds to S188.

In S188, the control circuit 20 sets the second update completion flag, and in subsequent S189, counts up the date/time information updated in S187, to thereby update the current date/time information. Then, the control circuit 20 terminates the acquired date/time count-up process.

The count-up of the date/time information in S189 is also performed in a case where it is determined in S185 that the second update completion flag is set, and in a case where it is determined in S186 that the battery date/time acquisition completion flag is not set.

As described above, in the acquired date/time count-up process in S180, the control circuit 20 repeatedly performs the process in S189 periodically as one of main routines, to thereby count up the date/time information periodically and measures the current date and time.

In a case where the date/time information has been acquired from the external appliance 8 or the battery pack 4 in the communication process in S140, the control circuit 20 updates such date and time being measured currently, based on the latest date/time information acquired from the external appliance 8 or the battery pack 4, and continues the measurement of date and time.

Figure 11:
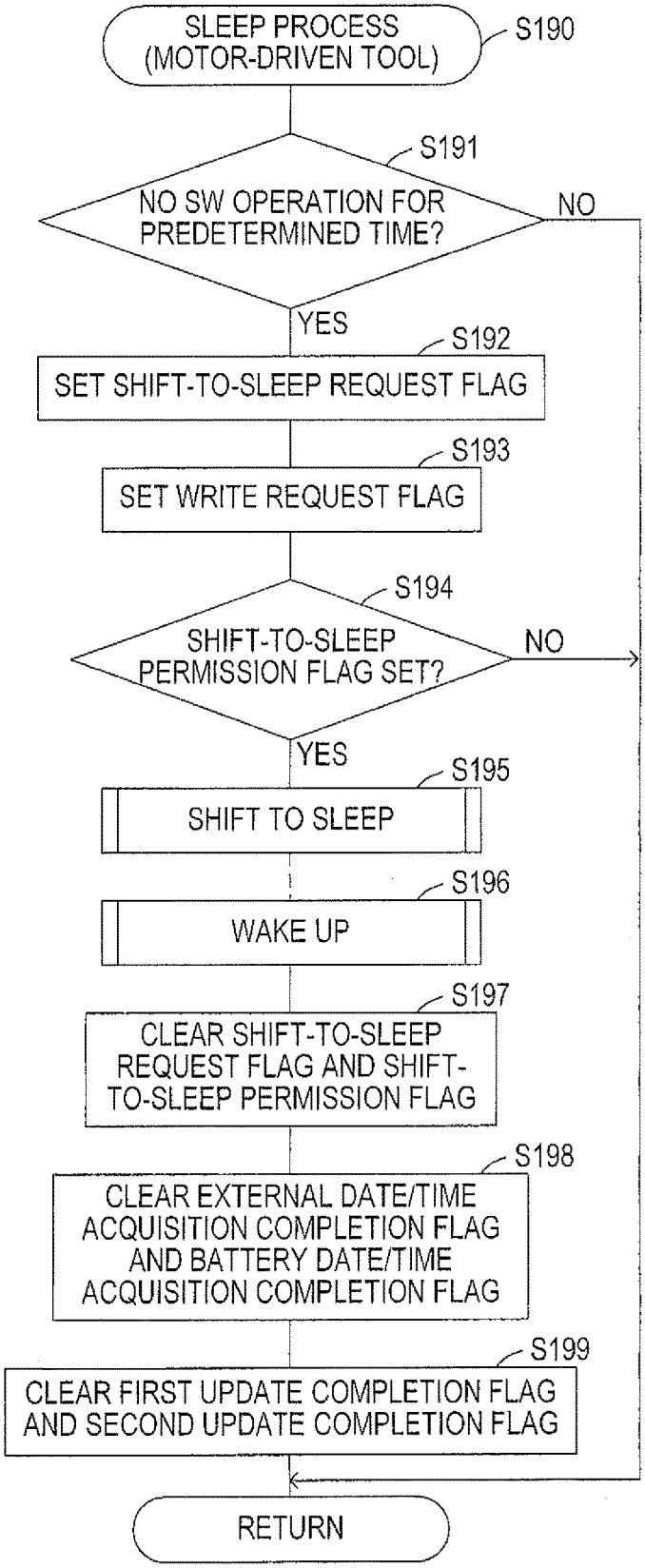
FIG. 11 is a flowchart showing a sleep process shown in FIG. 3.

Next, as shown in FIG. 11, in the sleep process in S190, the control circuit 20 determines in S191 whether a state in which switch operation of the trigger switch 23 or the like is not performed has continued for a predetermined period of time or longer. If the state in which switch operation is not performed has not continued for the predetermined period of time or longer, the control circuit 20 terminates the sleep process.

In contrast, if the state in which switch operation is not performed has continued for the predetermined period of time or longer, the process proceeds to S192. In S192, the control circuit 20 sets the shift-to-sleep request flag, and in subsequent S193, sets the write request flag. Then, the process proceeds to S194.

In S194, the control circuit 20 determines whether the shift-to-sleep permission flag is set, which is to be set when various pieces of information constituting history information (Memory Content 1) at the time of shifting to a sleep state are acquired in the write data preparation process in S174.

If the shift-to-sleep permission flag is not set, the control circuit 20 terminates the sleep process. If the shift-to-sleep permission flag is set, the process proceeds to S195, and the control circuit 20 stops performing the control process including the sleep process, to thereby shift to a sleep state, in which power consumption of the control circuit 20 is reduced.

Although the control circuit 20 shifts to a sleep state to thereby stop performing the control process, the control circuit 20 later wakes up when preset wake-up conditions, such as operation of the trigger switch 23, are met (S196).

After waking up, the control circuit 20 clears the shift-to-sleep request flag and the shift-to-sleep permission flag in S197, clears the external date/time acquisition completion flag and the battery date/time acquisition completion flag in S198, and clears the first update completion flag and the second update completion flag in S199. In this way, these respective flags are initialized, and the control circuit 20 terminates the sleep process.

As explained hereinabove, in the motor-driven tool 2, when the control circuit 20 shifts to a sleep state, when the control circuit 20 detects any abnormality, and when the control circuit 20 switches a control mode, the control circuit 20 stores history information including date/time information indicating the date and time at that time in the non-volatile memory 27.

The control circuit 20 acquires date/time information from the external appliance 8 or the battery pack 4 immediately after activation, and measures (counts) the current date and time based on the acquired date/time information.

When the control circuit 20 has acquired the date/time information from the battery pack 4 immediately after activation, the control circuit 20 later acquires the date/time information from the external appliance 8, and updates the date and time being measured currently, based on the date/time information. Furthermore, the control circuit 20 notifies the date/time information to the battery pack 4. Such notification causes the battery pack 4 to update the date and time being measured currently.

Therefore, according to the motor-driven tool 2 of the present embodiment, in the control circuit 20, it is possible to grasp the current date and time accurately, and thereby to assign accurate date/time information to the history information when storing the history information in the non-volatile memory 27.

Accordingly, the user of the motor-driven tool 2 can accurately grasp the operation history of the motor-driven tool 2 together with the date and time of the operation from the history information stored in the non-volatile memory 27, and can thereby perform traceability management of the motor-driven tool 2 properly.

When detecting any abnormalities, the control circuit 20 counts the number of detections of the abnormalities with respect to each content of the abnormalities, and assigns number-of-times information indicating the number of detections of each of the counted abnormalities to the history information to be stored in the non-volatile memory 27.

Therefore, even if old history information has been erased when writing the latest history information due to limitation of storage capacity of the non-volatile memory 27, the control circuit 20 can detect the number of detections of the abnormalities detected in the past for each content thereof from the history information stored in the non-volatile memory 27.

Consequently, according to the motor-driven tool 2 of the present embodiment, it can be suppressed that the traceability management of the motor-driven tool 2 becomes impossible due to the limitation of storage capacity of the non-volatile memory 27.

In the motor-driven tool 2 of the present embodiment, the control circuit 20, which comprises an MCU and performs the above-described control process, corresponds to one example of a communication unit, a date/time information acquisition unit, a control unit, and a measurement unit of the present invention, and the non-volatile memory 27 corresponds to one example of a storage unit of the present invention.

In the control process performed by the control circuit 20, especially, the communication process performed in S140 is one function of one example of the communication unit and the date/time information acquisition unit of the present invention; the mode setting switching process, the abnormal state confirmation process, the motor control process, and the memory operation process respectively performed in S130 and S150 to S170 are one function of one example of the control unit of the present invention; and the acquired date/time count-up process performed in S180 is one function of one example of the measurement unit of the present invention.

[Control Process by the Control Circuit 70 in the Charger 6]

Figure 12:
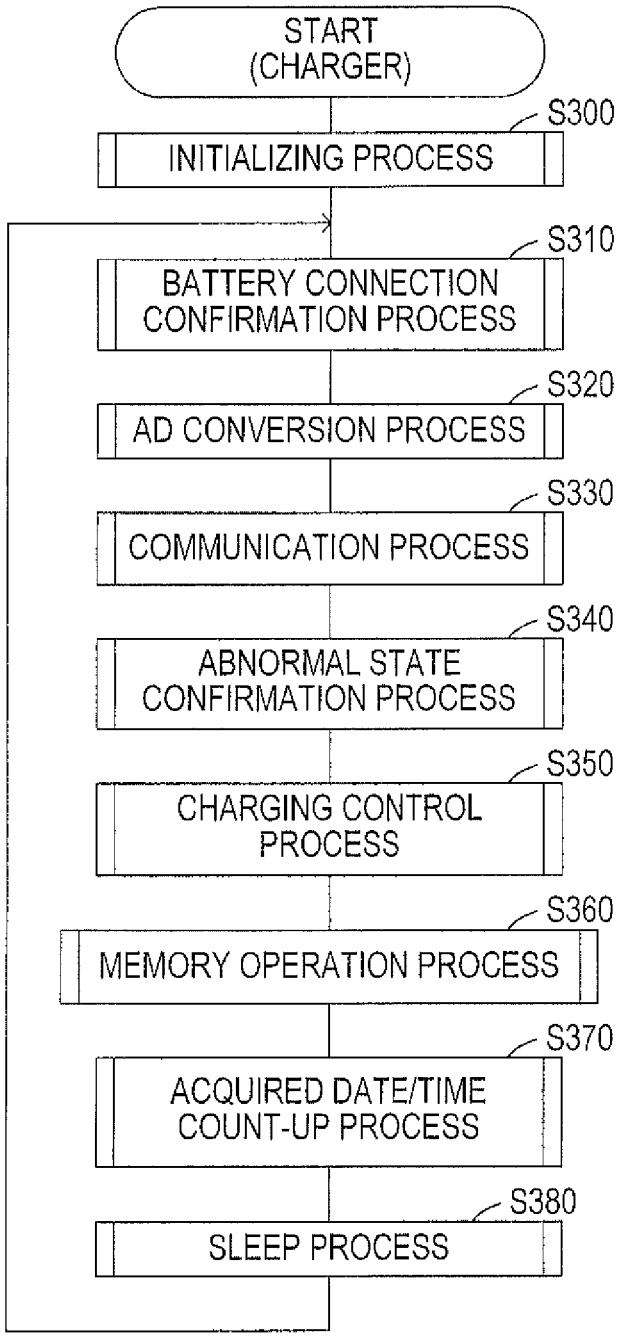
FIG. 12 is a flowchart showing a control process performed in a control circuit of the charger.

As shown in FIG. 12, when power is applied from the sub-converter 64 to start a control process, the control circuit 70 in the charger 6 performs an initializing process, in S300, that initializes various parameters and various flags to be described later, which are used for charging control of the battery 36.

In this initializing process, the control circuit 70 reads the number of detections of abnormal states to be stored as operation history of the charger 6 from the history information currently stored in the non-volatile memory 69 in order to generate new history information and write the new history information into the non-volatile memory 69 in a process to be described later, similarly to the case of the motor-driven tool 2.

Specifically, in the charger 6, the control circuit 70 stores history information indicating Memory Contents 1 to 5 shown in FIGS. 13A and 13B in the non-volatile memory 69 when the control circuit 70 shifts to a sleep state, when overvoltage of the battery 36 is detected, when overcurrent of the battery 36 is detected, when an charging status abnormality of the battery 36 is detected, and when a battery abnormality of the battery 36 is detected, respectively.

The charging status abnormality is an abnormality detected when charging of the battery 36 cannot be performed normally due to a difference between recognition of the battery pack 4 by the charger 6 and recognition of the charger 6 by the battery pack 4. The battery abnormality is an abnormality detected when any abnormality occurs in the battery 36, such as a battery temperature detected by the temperature measurement circuit 39.

When the control circuit 70 shifts to a sleep state, stored in the non-volatile memory 69 as history information is a data (Memory Content 1) composed of number-of-times information "1" indicating number of detections of overvoltage, number of detections of overcurrent, number of detections of charging status abnormality, and number of detections of battery abnormality; and date/time information "6" assigned thereto.

The number-of-times information "1" is stored in the non-volatile memory 69 as part of history information also when the above-described respective abnormalities are detected, similarly to the case of the motor-driven tool 2.

Therefore, in the initializing process in S300, the control circuit 70 reads the number of detections of the above-described respective abnormalities from the latest history information stored in the non-volatile memory 69, similarly to the initializing process in the motor-driven tool 2. The control circuit 70 is designed to thereby update the number of detections later when the above-described respective abnormalities are detected, and to store the history information, to which the updated number of detections is assigned, in the non-volatile memory 69.

The history information to be stored in the non-volatile memory 69 when overvoltage is detected, when overcurrent is detected, when a charging status abnormality is detected, and when a battery abnormality is detected is as described in FIGS. 13A and 13B as Memory Contents 2 to 5, respectively.

Specifically, when overvoltage is detected, stored in the non-volatile memory 69 as history information is a data (Memory Content 2) composed of information "2" indicating status information indicating a connection state of the battery pack 4, elapsed time of charging to the battery 36, and charging voltage at that time; and the number-of-times information "1" and the date/time information "6" assigned thereto.

When overcurrent is detected, stored in the non-volatile memory 69 as history information is a data (Memory Content 3) composed of information "3" indicating status information, charging current distribution, and charging elapsed time at that time; and the number-of-times information "1" and the date/time information "6" assigned thereto.

When a charging status abnormality is detected, stored in the non-volatile memory 69 as history information is a data (Memory Content 4) composed of information "4", which is similar to the information "3" at the time of detecting overcurrent, indicating status information, charging current distribution, and charging elapsed time at that time; and the number-of-times information "1" and the date/time information "6" assigned thereto.

When a battery abnormality is detected, stored in the non-volatile memory 69 as history information is a data (Memory Content 5) composed of information "5" indicating status information, battery status information (e.g., battery temperature), and charging elapsed time at that time; and the number-of-times information "1" and the date/time information "6" assigned thereto.

Next, in S310, the control circuit 70 confirms a connection state of the battery pack 4 to the charger 6, and in subsequent S320, imports AD conversion values of a charging voltage, a charging current, and the like.

In S330, the control circuit 70 performs a communication process that communicates with the external appliance 8 and the battery pack 4. In subsequent S340, the control circuit 70 performs an abnormal state confirmation process that confirms an occurrence state of overvoltage, overcurrent, and a charging status abnormality, which may occur when charging.

In S350, the control circuit 70 performs a charging control process that charges the battery 36. In this charging control process, when an abnormality has been detected in the abnormal state confirmation process, the control circuit 70 stops charging the battery 36 until the battery pack 4 is detached from the charger 6 later.

Next, In S360, the control circuit 70 performs a memory operation process that writes history information into the non-volatile memory 69, and in subsequent S370, performs an acquired date/time count-up process that updates (counts up) the current date and time based on the date/time information acquired from the external appliance 8.

Lastly, in S380, the control circuit 70 performs a sleep process, in which the control circuit 70 shifts to a sleep state when a state in which the battery pack 4 is not attached to the charger 6 has continued for a predetermined period of time or longer and wakes up when the battery pack 4 is connected after such shifting to a sleep state.

After the sleep process is performed, the process proceeds to S310 again. In this way, the control circuit 70 repeatedly performs the above-described series of processes.

Next, an explanation will be given below about processes related to writing of history information into the non-volatile memory 69, from among the above-described series of processes.

However, an explanation about a communication process in S330, a memory operation process (except a write data preparation process) in S360, and an acquired date/time count-up process in S370 is omitted here because these processes are respectively performed similarly to the communication process, the memory operation process, and the acquired date/time count-up process in the motor-driven tool 2 shown in FIG. 6, FIG. 8, and FIG. 10, respectively.

Figure 14:
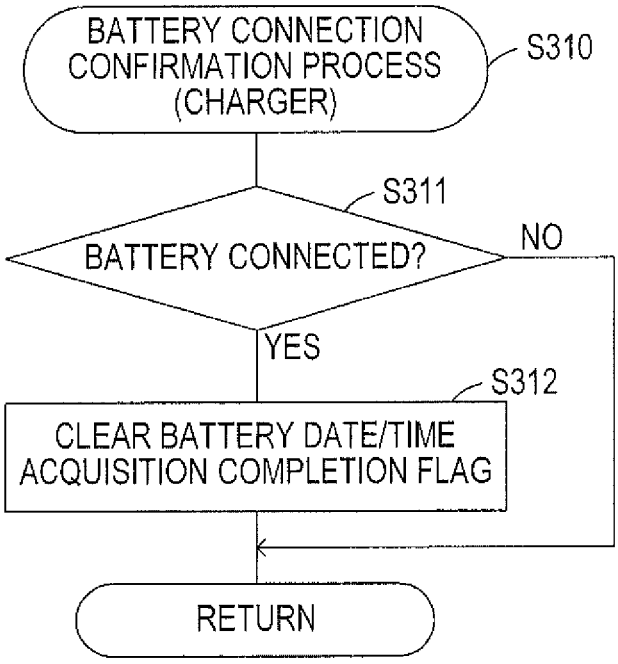
FIG. 14 is a flowchart showing a battery connection confirmation process shown in FIG. 12.

As shown in FIG. 14, in a battery connection confirmation process in S310, the control circuit 70 determines in S311 whether the battery pack 4 is connected to the charger 6. If the battery pack 4 is not connected, the control circuit 70 terminates the battery connection confirmation process.

If the battery pack 4 is connected, the process proceeds to S312. In S312, the control circuit 70 clears the battery date/time acquisition completion flag, and terminates the battery connection confirmation process.

Figure 15:
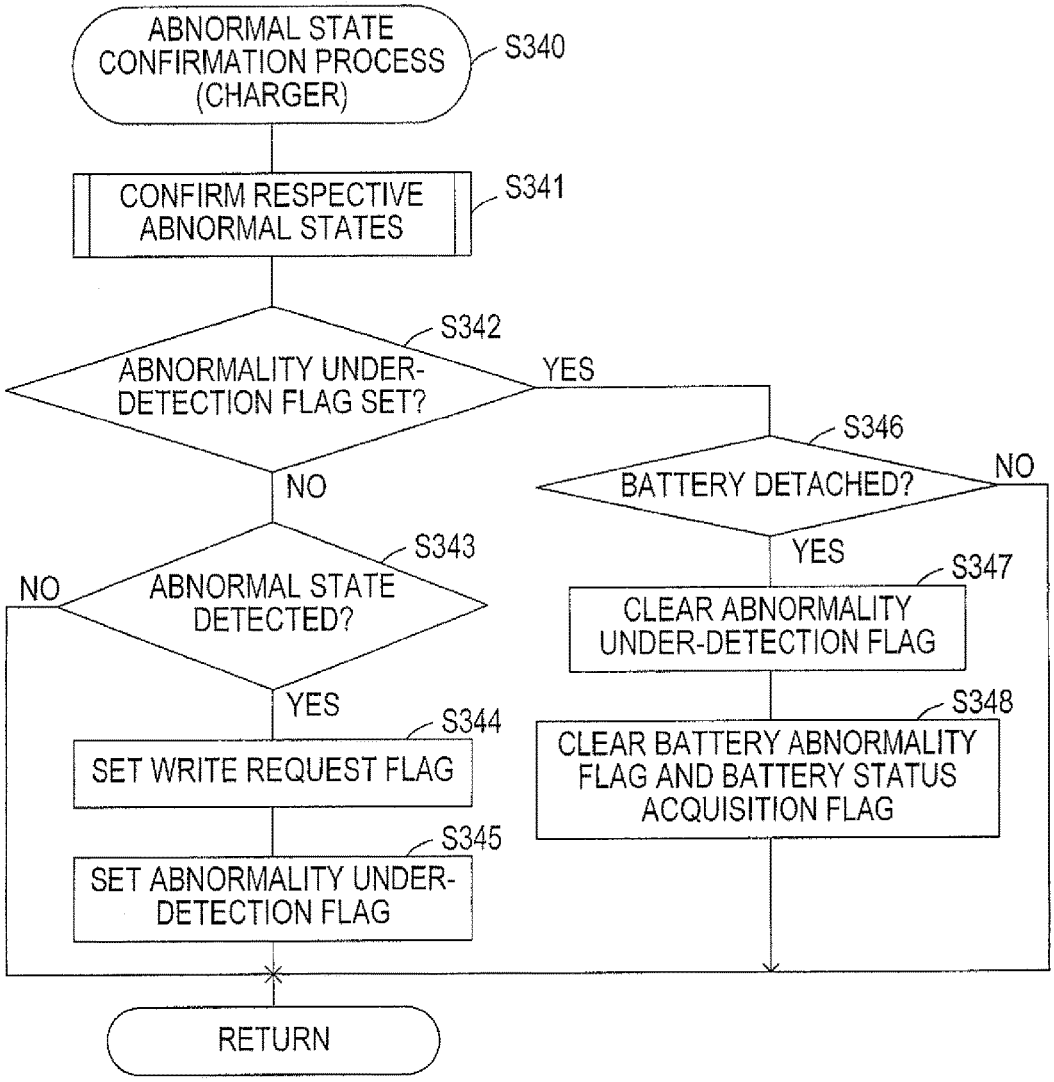
FIG. 15 is a flowchart showing an abnormal state confirmation process shown in FIG. 12.

Next, as shown in FIG. 15, in the abnormal state confirmation process in S340, the control circuit 70 confirms in S341 whether the above-described various abnormal states (overvoltage, overcurrent, charging status abnormality, and battery abnormality) have occurred, and the process proceeds to S342.

In S342, the control circuit 70 determines whether the abnormality under-detection flag is set. If the abnormality under-detection flag is not set, the control circuit 70 determines in S343 whether any abnormal state has been detected in S341.

If it is determined in S343 that an abnormal state has been detected, the process proceeds to S344. In S344, the control circuit 70 sets the write request flag in order to record the detected abnormal state as operation history of the charger 6, and in subsequent S345, sets the abnormality under-detection flag.

If it is determined in S343 that no abnormal state has been detected or when the abnormality under-detection flag is set in S345, the abnormal state confirmation process is terminated.

In contrast, if it is determined in S342 that the abnormality under-detection flag is set, the process proceeds to S346. In S346, the control circuit 70 determines whether the battery pack 4 has been detached from the charger 6. If the battery pack 4 has not been detached from the charger 6, the control circuit 70 terminates the abnormal state confirmation process. If the battery pack 4 has been detached from the charger 6, the control circuit 70 clears the abnormality under-detection flag in S347. After clearing the battery abnormality flag and the battery status acquisition flag in S348, the control circuit 70 terminates the abnormality confirmation process.

The reason why the above-described respective flags are cleared when the battery pack 4 is not attached to the charger 6 as above is to enable detection of an abnormal state also when the battery pack 4 is attached next time.

Since the write request flag is set when an abnormal state is detected in S343, every time an abnormal state is detected, history information to that effect is to be stored in the non-volatile memory 69 together with the number of detections thereof, similarly to the case of the motor-driven tool 2.

Figure 16:
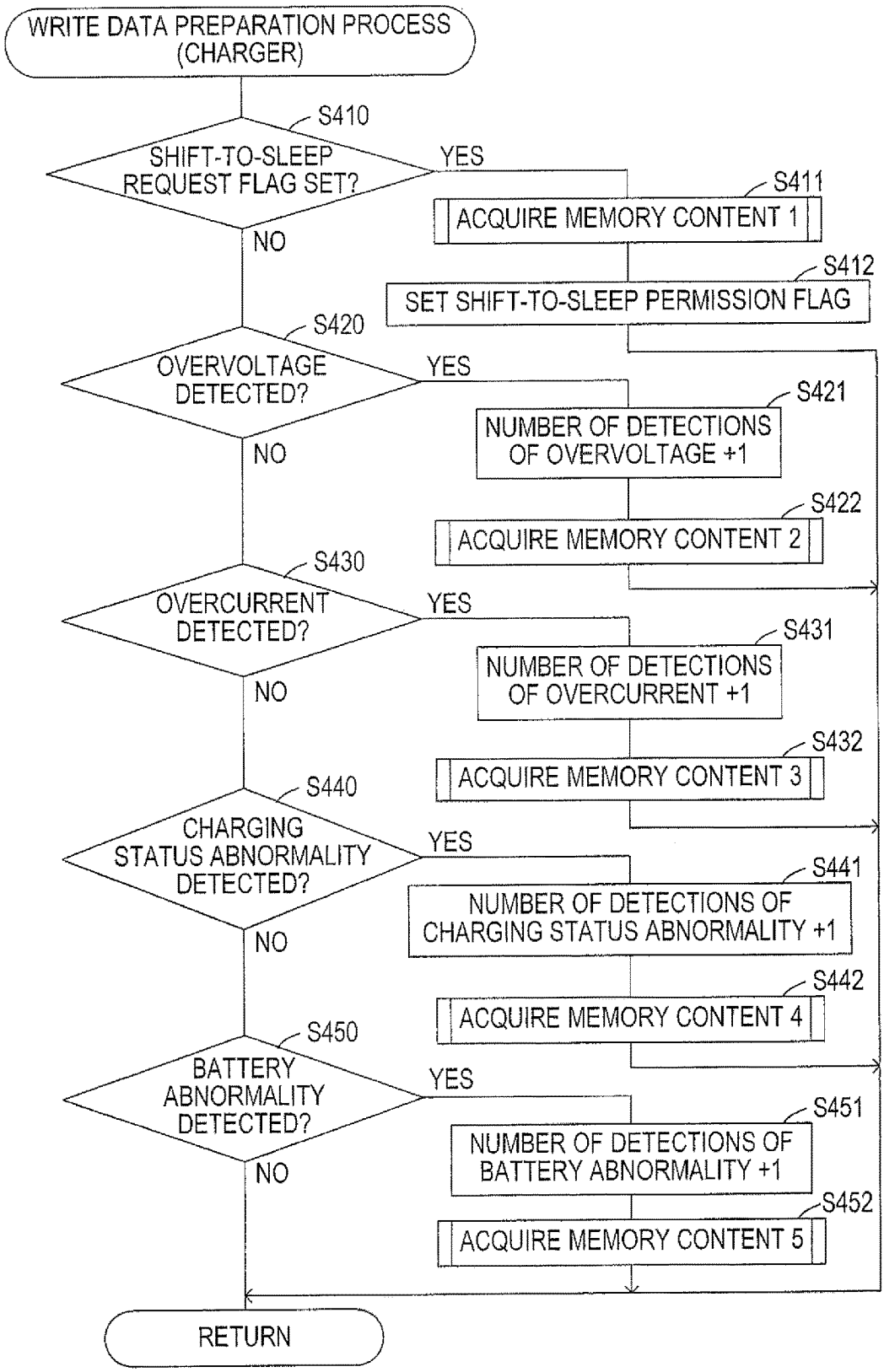
FIG. 16 is a flowchart showing a write data preparation process performed in a memory operation process shown in FIG. 12.

Next, as shown in FIG. 16, in the write data preparation process performed in the memory operation process in S360, the control circuit 70 first determines in S410 whether the shift-to-sleep request flag is set.

If the shift-to-sleep request flag is set, the process proceeds to S411. In S411, the control circuit 70 acquires latest values of various pieces of information (number of detections of overvoltage, number of detections of overcurrent, number of detections of charging status abnormality, number of detections of battery abnormality, and date/time information) constituting Memory Content 1 shown in FIG. 13A.

In subsequent S412, the control circuit 70 sets the shift-to-sleep permission flag, and terminates the write data preparation process.

Next, if it is determined in S410 that the shift-to-sleep request flag is not set, the process proceeds to S420. In S420, the control circuit 70 determines whether overvoltage has been detected in the abnormal state confirmation process in S340.

If overvoltage has been detected, the process proceeds to S421. In S421, the control circuit 70 increments (+1) the number of detections of overvoltage. In subsequent S422, the control circuit 70 acquires latest values of various pieces of information (status information, charging elapsed time, charging voltage, date/time information, and number of detections of respective abnormal states) constituting Memory Content 2 shown in FIG. 13A, and terminates the write data preparation process.

Next, if it is determined in S420 that no overvoltage has been detected, the process proceeds to S430, and the control circuit 70 determines whether overcurrent has been detected in the abnormal state confirmation process in S340.

If overcurrent has been detected, the process proceeds to S431. In S431, the control circuit 70 increments (+1) the number of detections of overcurrent. In subsequent S432, the control circuit 70 acquires latest values of various pieces of information (status information, charging current distribution, charging elapsed time, date/time information, and number of detections of respective abnormal states) constituting Memory Content 3 shown in FIG. 13A, and terminates the write data preparation process.

Next, if it is determined in S430 that no overcurrent has been detected, the process proceeds to S440. In S440, the control circuit 70 determines whether a charging status abnormality has been detected in the abnormal state confirmation process in S340.

If a charging status abnormality has been detected, the process proceeds to S441. In S441, the control circuit 70 increments (+1) the number of detections of charging status abnormality. In subsequent S442, the control circuit 70 acquires latest values of various pieces of information (status information, charging current distribution, charging elapsed time, date/time information, and number of detections of respective abnormal states) constituting Memory Content 4 shown in FIG. 13B, and terminates the write data preparation process.

If it is determined in S440 that no charging status abnormality has been detected, the process proceeds to S450. In S450, the control circuit 70 determines whether a battery abnormality has been detected in the abnormal state confirmation process in S340.

If a battery abnormality has been detected, the process proceeds to S451. In S451, the control circuit 70 increments (+1) the number of detections of battery abnormality. In subsequent S452, the control circuit 70 acquires latest values of various pieces of information (status information, battery status information, charging elapsed time, date/time information, and number of detections of respective abnormal states) constituting Memory Content 5 shown in FIG. 13B, and terminates the write data preparation process.

In a case also where it is determined in S450 that no battery abnormality has been detected, the control circuit 70 terminates the write data preparation process.

As described above, in the memory operation process in S360, when the write request flag is set, the control circuit 70 performs the write data preparation process shown in FIG. 16, to thereby collect various pieces of information constituting history information (Memory Contents 1 to 5 shown in FIGS. 13A and 13B) that should be written into the non-volatile memory 69. Then, the control circuit 70 generates history information based on the collected various pieces of information, and stores the generated history information in the non-volatile memory 69.

Figure 17:
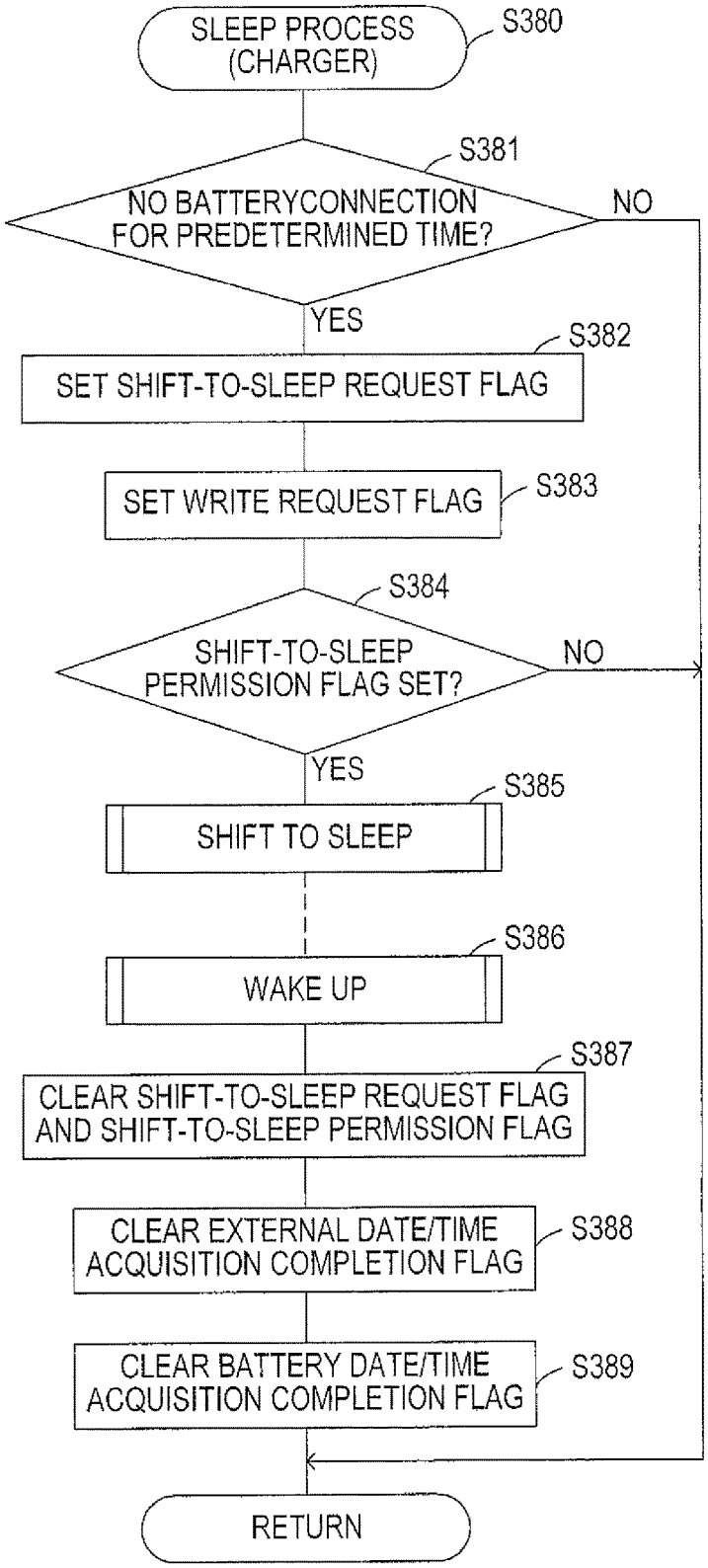
FIG. 17 is a flowchart showing a sleep process shown in FIG. 12.

Next, as shown in FIG. 17, in the sleep process in S380, the control circuit 70 determines in S381 whether a state in which the battery pack 4 is not attached to the charger 6 has continued for a predetermined period of time or longer. If the state in which the battery pack 4 is not attached has not continued for the predetermined period of time or longer, the control circuit 70 terminates the sleep process.

In contrast, if the state in which the battery pack 4 is not attached has continued for the predetermined period of time or longer, the process proceeds to S382. The control circuit 70 sets the shift-to-sleep request flag in S382, and sets the write request flag in subsequent S383. Then, the process proceeds to S384.

In S384, the control circuit 70 determines whether the shift-to-sleep permission flag is set, which is to be set when various pieces of information constituting history information (Memory Content 1) at the time of shifting to a sleep state are acquired in the write data preparation process shown in FIG. 16.

If the shift-to-sleep permission flag is not set, the control circuit 70 terminates the sleep process. If the shift-to-sleep permission flag is set, the process proceeds to S385. In S385, the control circuit 70 stops performing the control process including the sleep process. In this way, the control circuit 70 shifts to a sleep state, in which power consumption of the control circuit 70 is reduced.

Although the control circuit 70 shifts to a sleep state to thereby stop performing the control process, the control circuit 70 later wakes up when preset wake-up conditions, such as attachment of the battery pack 4, are met (S386).

After waking up, the control circuit 70 clears the shift-to-sleep request flag and the shift-to-sleep permission flag in S387, clears the external date/time acquisition completion flag in S388, and clears the battery date/time acquisition completion flag in S389. In this way, the control circuit 70 initializes these respective flags, and terminates the sleep process.

As explained hereinabove, in the charger 6, when the control circuit 70 shifts to a sleep state and when the control circuit 70 detects any abnormality, the control circuit 70 stores history information including the date/time information indicating the date and time at that time in the non-volatile memory 69.

The control circuit 70 acquires the date/time information from the external appliance 8 or the battery pack 4 immediately after activation by performing the communication process through procedures similar to those in the motor-driven tool 2, and measures (counts) the current date and time based on the acquired date/time information.

Therefore, according to the charger 6 of the present embodiment, in the control circuit 70, it is possible to grasp the current date and time accurately, and thereby to assign accurate date/time information to the history information when storing the history information in the non-volatile memory 69, similarly to the case of the motor-driven tool 2.

Accordingly, the user of the charger 6 can accurately grasp the operation history of the charger 6 together with the date and time of the operation from the history information stored in the non-volatile memory 69, and can thereby perform traceability management of the charger 6 properly.

Since the number-of-times information indicating the number of detections of various abnormal states is assigned to history information when the history information is stored in the non-volatile memory 69, even if old history information stored in the non-volatile memory 69 has been erased in order to write the history information, the control circuit 70 can detect the number of detections of the abnormalities detected in the past for each content thereof from the history information stored in the non-volatile memory 69.

Therefore, also in the charger 6, it can be suppressed that the traceability management of the charger 6 becomes impossible due to limitation of storage capacity of the non-volatile memory 69, similarly to the case of the motor-driven tool 2.

In the charger 6 of the present embodiment, the control circuit 70 corresponds to one example of the communication unit, the date/time information acquisition unit, the control unit, and the measurement unit of the present invention, and the non-volatile memory 69 corresponds to one example of the storage unit of the present invention.

In the control process performed by the control circuit 70, especially, the communication process performed in S330 is one function of one example of the communication unit and the date/time information acquisition unit of the present invention; the abnormal state confirmation process, the charging control process, and the memory operation process respectively performed in S340 to S360 are one function of one example of the control unit of the present invention; and the acquired date/time count-up process performed in S370 is one function of one example of the measurement unit of the present invention.

[Control Process by the Control Circuit 40 in the Battery Pack 4]

Figure 18:
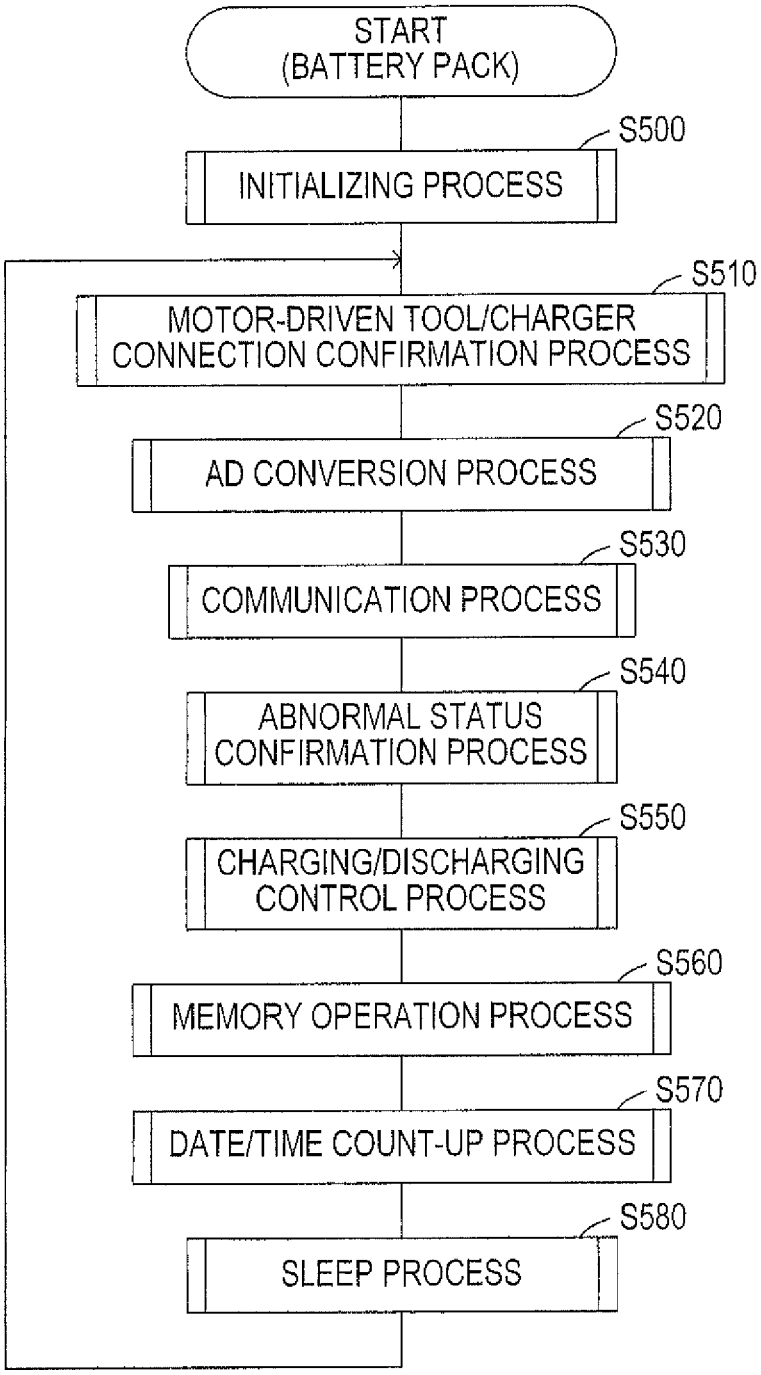
FIG. 18 is a flowchart showing a control process performed by a control circuit of the battery pack.

As shown in FIG. 18, when power is applied from the regulator 44 to start a control process, the control circuit 40 in the battery pack 4 performs an initializing process, in S500, that initializes various parameters and various flags to be described later, which are used for charging/discharging control of the battery 36.

In this initializing process, the control circuit 40 reads the number of detections of abnormal states from the latest history information currently stored in the non-volatile memory 45 in order to generate new history information and write the new history information into the non-volatile memory 45 in a process to be described later, similarly to the cases of the motor-driven tool 2 and the charger 6.

Specifically, in the battery pack 4, the control circuit 40 stores history information indicating Memory Contents 1 to 4 shown in FIG. 19 in the non-volatile memory 45 when the control circuit 40 shifts to a sleep state, when overvoltage of the battery 36 is detected, when overcurrent of the battery 36 is detected, and when battery abnormality of the battery 36 is detected, respectively.

When the control circuit 40 shifts to a sleep state, stored in the non-volatile memory 45 as history information is a data (Memory Content 1) composed of number-of-times information "1" indicating number of detections of overvoltage, number of detections of overcurrent, and number of detections of battery abnormality; and date/time information "5", to which difference information to be described later has been added, assigned thereto.

The number-of-times information "1" is stored in the non-volatile memory 45 as part of history information also when the above-described respective abnormalities are detected, similarly to the cases of the motor-driven tool 2 and the charger 6.

Therefore, in the initializing process in S500, the control circuit 40 reads the number of detections of the above-described respective abnormal states from the latest history information stored in the non-volatile memory 45, similarly to the initializing processes in the motor-driven tool 2 and the charger 6. The control circuit 40 is designed to thereby update the number of detections later when the above-described respective abnormalities are detected, and to store the history information, to which the updated number of detections has been assigned, in the non-volatile memory 45.

The history information to be stored in the non-volatile memory 45 when overvoltage is detected, when overcurrent is detected, and when a battery abnormality is detected is as described in FIG. 19 as Memory Contents 2 to 4, respectively.

Specifically, when overvoltage is detected, stored in the non-volatile memory 45 as history information is a data (Memory Content 2) composed of information "2" indicating status information indicating a connection state to the motor-driven tool 2 or the charger 6, elapsed time of charging to the battery 36, and charging voltage at that time; and the number-of-times information "1" and the date/time information "5" assigned thereto.

When overcurrent is detected, stored in the non-volatile memory 45 as history information is a data (Memory Content 3) composed of information "3" indicating status information, charging/discharging current distribution, and charging/discharging elapsed time at that time; and the number-of-times information "1" and the date/time information "5" assigned thereto.

When a battery abnormality is detected, stored in the non-volatile memory 45 as history information is a data (Memory Content 4) composed of information "4" indicating status information, battery status information (e.g., battery temperature), and charging/discharging elapsed time at that time; and the number-of-times information "1" and the date/time information "5" assigned thereto.

Next, in S510, the control circuit 40 confirms a connection state of the battery pack 4 to the motor-driven tool 2 or the charger 6, and in subsequent S520, imports AD conversion values of a battery voltage, a battery current, a battery temperature, and the like.

In S530, the control circuit 40 performs a communication process that communicates with the motor-driven tool 2 or the charger 6, to which the battery pack 4 is connected. In subsequent S540, the control circuit 40 performs an abnormal state confirmation process that confirms an occurrence state of abnormalities, such as overvoltage, overcurrent, and battery abnormality.

In S550, the control circuit 40 performs a charging/discharging control process that controls discharge from the battery 36 or charging to the battery 36 in accordance with the connection state to the motor-driven tool 2 or the charger 6. In this charging/discharging control process, when an abnormality has been detected in the abnormal state confirmation process, the control circuit 40 stops charging/discharging of the battery 36 until the battery pack 4 is detached from the motor-driven tool 2 or the charger 6 later.

Next, in S560, the control circuit 40 performs a memory operation process that writes history information into the non-volatile memory 45, and in subsequent S570, performs a date/time count-up process that measures the date and time by updating (counting up) the current date and time.

Lastly, in S580, the control circuit 40 performs a sleep process, in which the control circuit 40 shifts to a sleep state when a state in which the battery pack 4 is not connected to either of the motor-driven tool 2 or the charger 6 has continued for a predetermined period of time or longer and wakes up when the battery pack 4 is connected to the motor-driven tool 2 or the charger 6 after such shifting to a sleep state.

After the sleep process is performed, the process proceeds to S510 again. In this way, the control circuit 40 repeatedly performs the above-described series of processes.

Next, an explanation will be given below about processes related to writing of history information into the non-volatile memory 45, from among the above-described series of processes.

However, an explanation about a memory operation process (except a write data preparation process) in S530 is omitted here because this process is performed similarly to the memory operation process in the motor-driven tool 2 shown in FIG. 8.

Differently from the acquired date/time count-up processes performed in the motor-driven tool 2 and the charger 6, the date/time count-up process in S570 is periodically performed also when the control circuit 40 is in a sleep state, while the regulator 44 is supplying power to the control circuit 40 by receiving power supply from the battery 36.

In S570, the control circuit 40 sequentially counts up the date and time set when the battery pack 4 was manufactured, to thereby measure current date and time independently in the battery pack 4.

Figure 20:
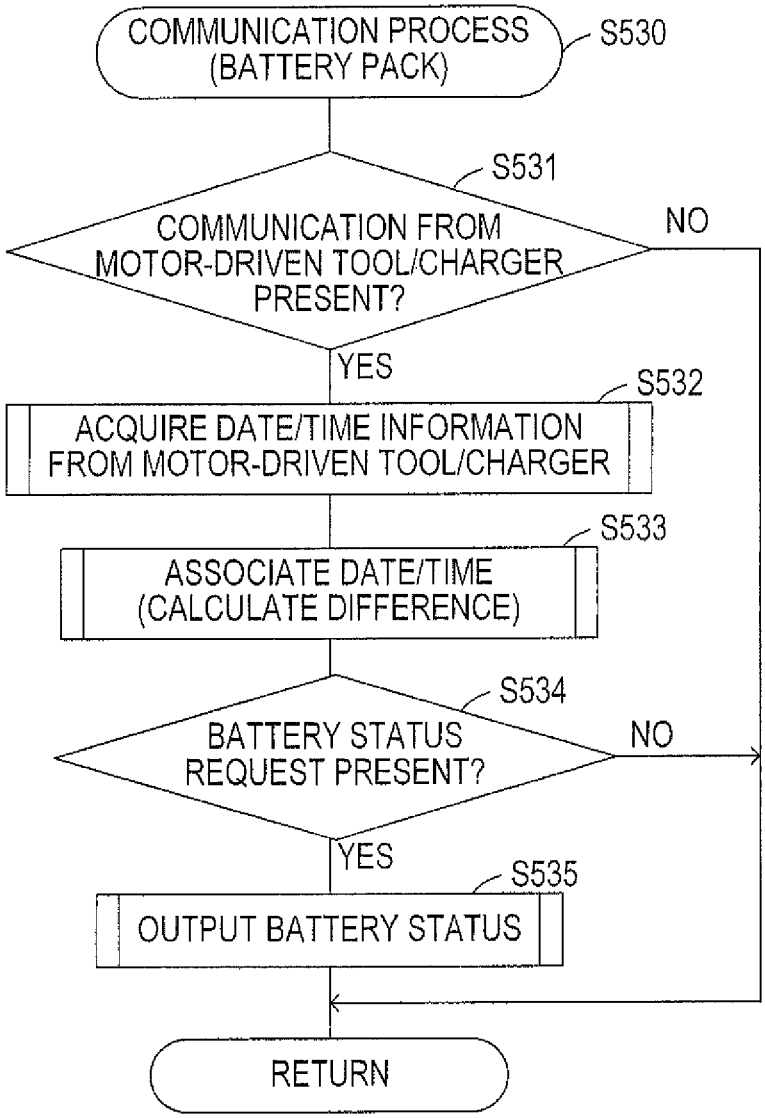
FIG. 20 is a flowchart showing a communication process shown in FIG. 18.

As shown in FIG. 20, in the communication process in S530, the control circuit 40 first determines in S531 whether there has been a communication from the motor-driven tool 2 or the charger 6, to which the battery pack 4 is connected.

If there has been a communication from the motor-driven tool 2 or the charger 6, the process proceeds to S532. In S532, the control circuit 40 acquires current date/time information included in data transmitted from the motor-driven tool 2 or the charger 6.

Next, in S533, the control circuit 40 calculates a difference between the current date and time obtained from the date/time information acquired in S532 and the current date and time that the control circuit 40 recognizes (counts, in other words), and associates the calculated difference, as difference information, with the date and time being counted currently.

In subsequent S534, the control circuit 40 determines whether there has been a request for the battery status information from the motor-driven tool 2 or the charger 6, to which the battery pack 4 is connected.

If there has been a request for the battery status information from the motor-driven tool 2 or the charger 6, the control circuit 40 outputs, in S535, the requested battery status information to the motor-driven tool 2 or the charger 6, and then terminates the communication process. If there has been no request for the battery status information, the control circuit 40 terminates the communication process without taking any action.

As described above, in the communication process in S530, the control circuit 40 performs acquisition of the date/time information and transmission of the battery status information in accordance with communication from the motor-driven tool 2 or the charger 6. This is because the battery pack 4 is designed to be a slave and the motor-driven tool 2 or the charger 6 is designed to be a master during communication between the battery pack 4 and the motor-driven tool 2 or the charger 6, as described above.

Figure 21:
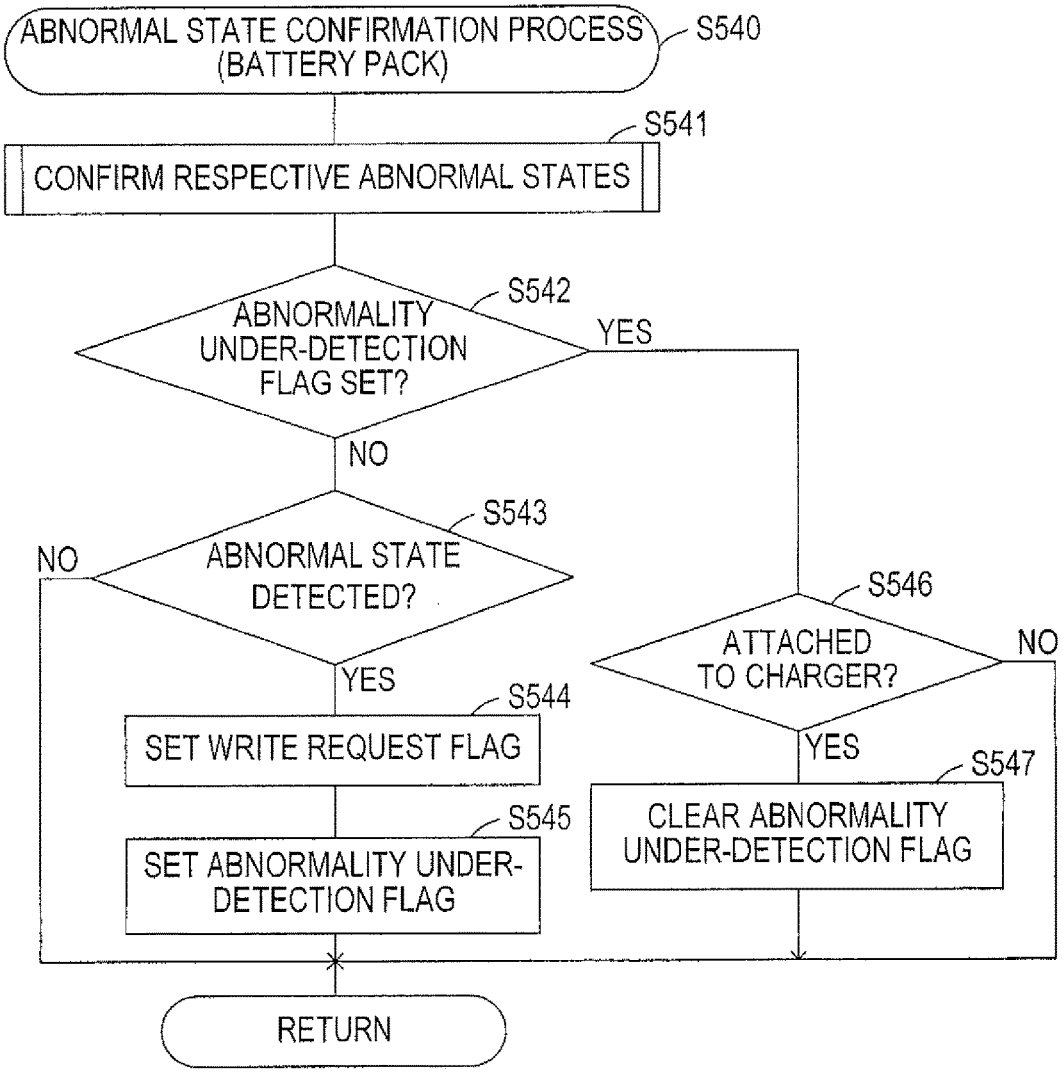
FIG. 21 is a flowchart showing an abnormal state confirmation process shown in FIG. 18.

Next, as shown in FIG. 21, in the abnormal state confirmation process in S540, the control circuit 40 confirms in S541 whether the above-described various abnormal states (overvoltage, overcurrent, and battery abnormality) have occurred, and the process proceeds to S542.

In S542, the control circuit 40 determines whether the abnormality under-detection flag is set. If the abnormality under-detection flag is not set, the control circuit 40 determines in S543 whether any abnormal state has been detected in S541.

If it is determined in S543 that an abnormal state has been detected, the process proceeds to S544. In S544, the control circuit 40 sets the write request flag in order to record the detected abnormal state as operation history of the battery pack 4, and in subsequent S545, sets the abnormality under-detection flag.

If it is determined in S543 that no abnormal state has been detected, or when the abnormality under-detection flag is set in S545, the abnormal state confirmation process is terminated.

In contrast, if it is determined in S542 that the abnormality under-detection flag is set, the process proceeds to S546. In S546, the control circuit 40 determines whether the battery pack 4 has been attached to the charger 6 after once detached from the motor-driven tool 2 or the charger 6.

If the battery pack 4 has been attached anew to the charger 6, the control circuit 40 clears the abnormality under-detection flag in S547, and then, terminates the abnormal state confirmation process. If the battery pack 4 has not been attached anew to the charger 6, the control circuit 40 terminates the abnormal state confirmation process without taking any action.

The reason why the abnormality under-detection flag is cleared when the battery pack 4 has been attached anew to the charger 6 as above is to enable detection of the above-described various abnormal states also in a case where the battery pack 4 is attached to the charger 6 next time to start charging and, subsequently, is attached to the motor-driven tool 2 to supply power to the motor-driven tool 2.

If an abnormal state is detected in S543, the write request flag is set. Therefore, every time an abnormal state is detected, history information to that effect is to be stored in the non-volatile memory 45 together with the number of detections thereof, similarly to the cases of the motor-driven tool 2 and the charger 6.

Figure 22:
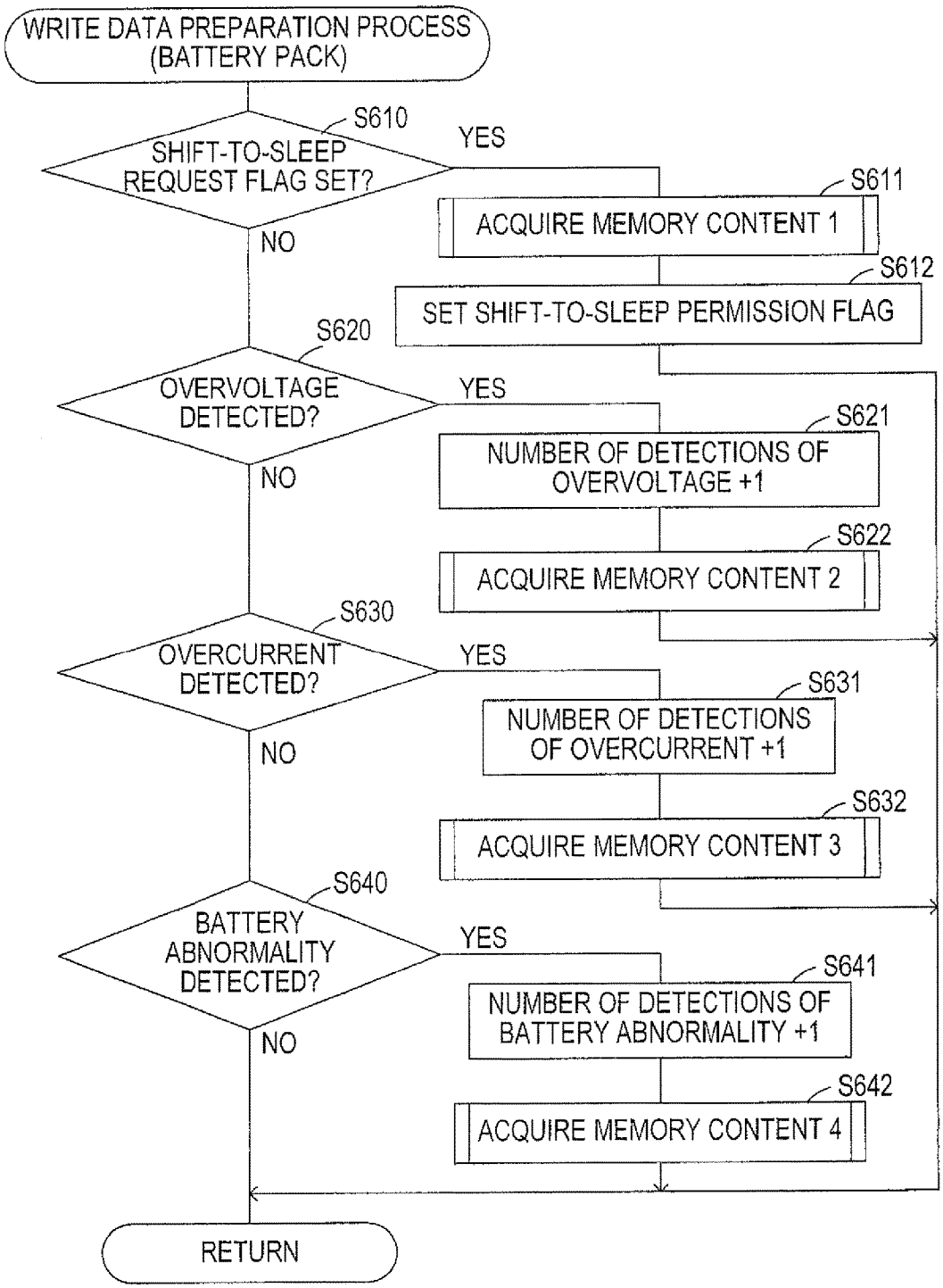
FIG. 22 is a flowchart showing a write data preparation process performed in a memory operation process shown in FIG. 18.

Next, as shown in FIG. 22, in the write data preparation process performed in the memory operation process in S560, the control circuit 40 first determines in S610 whether the shift-to-sleep request flag is set.

If the shift-to-sleep request flag is set, the process proceeds to S611. In S611, the control circuit 40 acquires latest values of various pieces of information (number of detections of overvoltage, number of detections of overcurrent, number of detections of battery abnormality, and date/time information including the difference information associated in S533) constituting Memory Content 1 shown in FIG. 19. In subsequent S612, the control circuit 40 sets the shift-to-sleep permission flag, and terminates the write data preparation process.

If it is determined in S610 that the shift-to-sleep request flag is not set, the process proceeds to S620. In S620, the control circuit 40 determines whether overvoltage has been detected in the abnormal state confirmation process in S540.

If overvoltage has been detected, the process proceeds to S621. In S621, the control circuit 40 increments (+1) the number of detections of overvoltage. In subsequent S622, the control circuit 40 acquires latest values of various pieces of information (status information, charging elapsed time, charging voltage, date/time information including difference information, and number of detections of respective abnormal states) constituting Memory Content 2 shown in FIG. 19, and terminates the write data preparation process.

If it is determined in S620 that no overvoltage has been detected, the process proceeds to S630, and the control circuit 40 determines whether overcurrent has been detected in the abnormal state confirmation process in S540.

If overcurrent has been detected, the process proceeds to S631. In S631, the control circuit 40 increments (+1) the number of detections of overcurrent. In subsequent S632, the control circuit 40 acquires latest values of various pieces of information (status information, charging/discharging current distribution, charging/discharging elapsed time, date/time information including difference information, and number of detections of respective abnormal states) constituting Memory Content 3 shown in FIG. 19, and terminates the write data preparation process.

If it is determined in S630 that no overcurrent has been detected, the process proceeds to S640. In S640, the control circuit 40 determines whether a battery abnormality has been detected in the abnormal state confirmation process in S540.

If a battery abnormality has been detected, the process proceeds to S641. In S641, the control circuit 40 increments (+1) the number of detections of battery abnormality. In subsequent S642, the control circuit 40 acquires latest values of various pieces of information (status information, battery status information, charging/discharging elapsed time, date/time information including difference information, and number of detections of respective abnormal states) constituting Memory Content 4 shown in FIG. 19, and terminates the write data preparation process.

In a case also where it is determined in S640 that no battery abnormality has been detected, the control circuit 40 terminates the write data preparation process.

As described above, in the memory operation process in S560, when the write request flag is set, the control circuit 40 performs the write data preparation process shown in FIG. 22, to thereby collect various pieces of information constituting history information (Memory Contents 1 to 4 shown in FIG. 19) that should be written into the non-volatile memory 45. Then, the control circuit 40 generates history information based on the collected various pieces of information, and stores the generated history information in the non-volatile memory 45.

Figure 23:
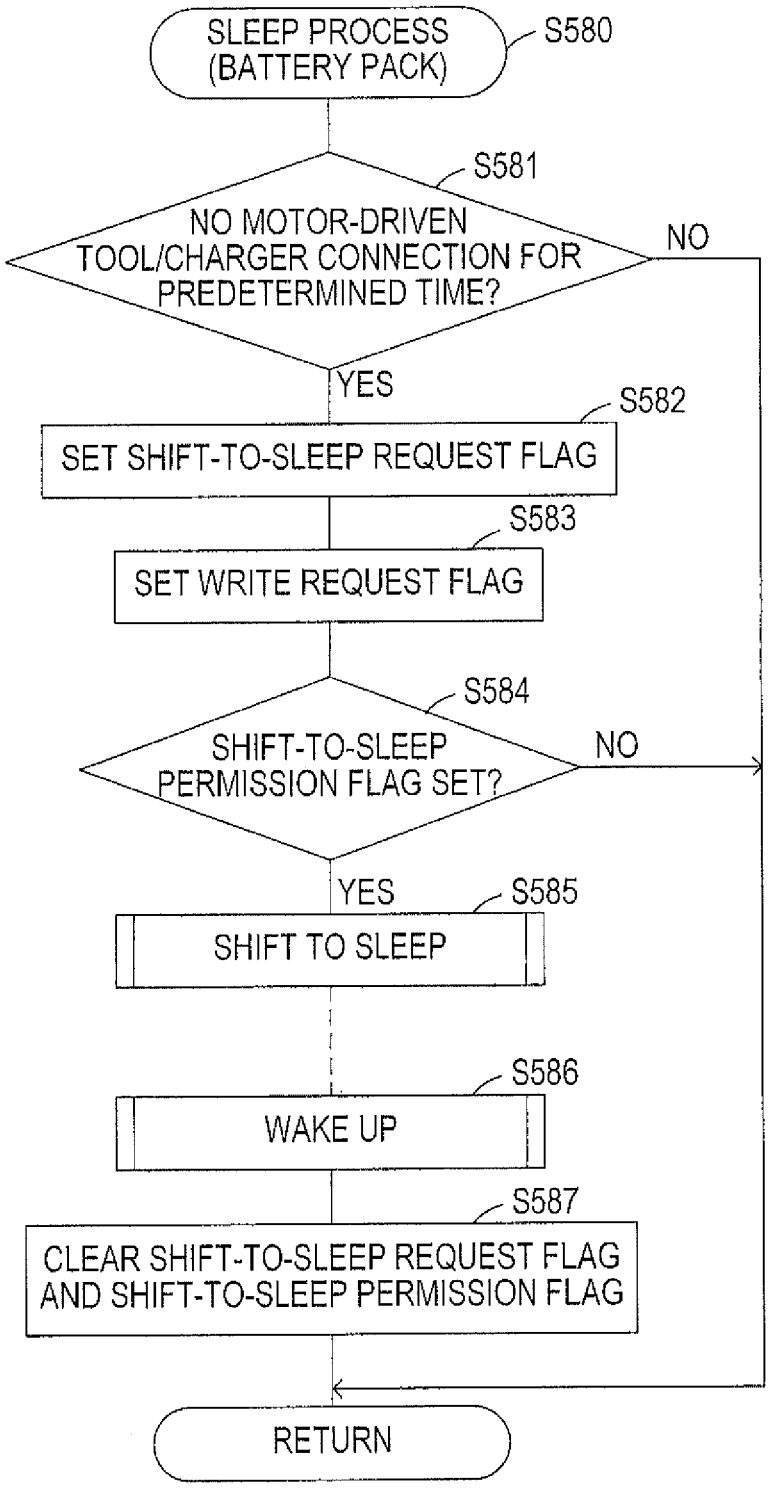
FIG. 23 is a flowchart showing a sleep process shown in FIG. 18.

Next, as shown in FIG. 23, in the sleep process in S580, the control circuit 40 determines in S581 whether a state in which the battery pack 4 is not attached to the motor-driven tool 2 or the charger 6 has continued for a predetermined period of time or longer. If the state in which the battery pack 4 is not attached to the motor-driven tool 2 or the charger 6 has not continued for the predetermined period of time or longer, the control circuit 40 terminates the sleep process.

In contrast, if the state in which the battery pack 4 is not attached to the motor-driven tool 2 or the charger 6 has continued for the predetermined period of time or longer, the process proceeds to S582. In S582, the control circuit 40 sets the shift-to-sleep request flag, and in subsequent S583, sets the write request flag. Then, the process proceeds to S584.

In S584, the control circuit 40 determines whether the shift-to-sleep permission flag is set, which is to be set when various pieces of information constituting history information (Memory Content 1) at the time of shifting to a sleep state are acquired in the write data preparation process shown in FIG. 22.

If the shift-to-sleep permission flag is not set, the control circuit 40 terminates the sleep process. If the shift-to-sleep permission flag is set, the process proceeds to S585. In S585, the control circuit 40 stops performing the control process including the sleep process. In this way, the control circuit 40 shifts to a sleep state, in which power consumption of the control circuit 40 is reduced.

As described above, in the battery pack 4, the control circuit 40 is periodically activated, even in a sleep state, in order to perform the date/time count-up process in S570, and continues measurement of the date and time.

After shifting to a sleep state, when the battery pack 4 is attached to the motor-driven tool 2 or the charger 6 to thereby meet predetermined wake-up conditions, the control circuit 40 wakes up (S586).

After waking up, the control circuit 40 clears the shift-to-sleep request flag and the shift-to-sleep permission flag in S587. In this way, the control circuit 40 initializes these respective flags, and terminates the sleep process.

As explained hereinabove, in the battery pack 4, when the control circuit 40 shifts to a sleep state, and when the control circuit 40 detects any abnormality, the control circuit 40 stores history information including the date/time information indicating the date and time at that respective times in the non-volatile memory 45.

When the battery pack 4 is attached to the motor-driven tool 2 or the charger 6, the control circuit 40 acquires the date/time information (specifically, the date/time information acquired by the motor-driven tool 2 or the charger 6 from the external appliance 8) from the motor-driven tool 2 or the charger 6.

Then, the control circuit 40 calculates a difference between the date and time obtained from the acquired date/time information and the date and time being measured currently on the part of the battery pack 4 as difference information, and assigns the date/time information including the difference information to the history information when storing the history information in the non-volatile memory 45.

Therefore, according to the battery pack 4 of the present embodiment, in the control circuit 40, the current date and time can be grasped accurately based on the date and time measured in the date/time count-up process and the difference information.

Since the history information with the date/time information including the difference information assigned thereto is stored in the non-volatile memory 45, the user of the battery pack 4 can accurately grasp the operation history of the battery pack 4 together with the date and time of the operation from the history information stored in the non-volatile memory 45, and can thereby perform traceability management of the battery pack 4 properly.

Since the number-of-times information indicating the number of detections of various abnormal states is assigned to the history information when the history information is stored in the non-volatile memory 45, even if old history information stored in the non-volatile memory 45 has been erased in order to write the history information, the control circuit 40 can detect the number of detections of the abnormalities detected in the past for each content thereof from the history information stored in the non-volatile memory 45.

Consequently, also in the battery pack 4, it can be suppressed that the traceability management of the battery pack 4 becomes impossible due to limitation of storage capacity of the non-volatile memory 45, similarly to the cases of the motor-driven tool 2 and the charger 6.

For example, when the control circuit 40 completely stops operating due to decrease in battery voltage or the like, the date/time count-up process in S570 is also stopped, and thereby it becomes impossible to continue measurement of the date and time. However, when the battery voltage rises by charging and the control circuit 40 starts operating, the difference information is generated and, thus, the control circuit 40 can accurately detect the current date and time from the difference information and information on the date and time being measured currently. In addition, it is possible to estimate operation stop time of the control circuit 40 (in other words, voltage drop period of the battery 36) from the difference information.

In the battery pack 4 of the present embodiment, the control circuit 40 corresponds to one example of the communication unit, the date/time information acquisition unit, the control unit, and the measurement unit of the present invention, and the non-volatile memory 45 corresponds to one example of the storage unit of the present invention.

In the control process performed by the control circuit 40, especially, the communication process performed in S530 is one function of one example of the communication unit and the date/time information acquisition unit of the present invention; the abnormal state confirmation process, the charging control process, and the memory operation process respectively performed in S540 to S560 are one function of one example of the control unit of the present invention; and the date/time count-up process performed in S570 is one function of one example of the measurement unit of the present invention.

Modified Examples

Although the embodiments of the present invention have been described hereinabove, the present invention is not limited to the above-described embodiments, and can take various forms within a scope not departing from the spirit of the present invention.

In the above-described embodiments, the control circuits 20, 40, and 70 respectively in the motor-driven tool 2, the battery pack 4, and the charger 6 have been explained such that the history information to be stored respectively in the non-volatile memories 27, 45, and 69 is all assigned with the number-of-times information indicating the number of detections of respective abnormal states.

However, as for the number of detections of respective abnormal states, the latest values thereof are read from the non-volatile memories 27, 45, and 69 when the respective control circuits 20, 40, and 70 start the control processes, and the number of detections of respective abnormal states is updated in the subsequent respective control processes.

Therefore, as in the case of history information of a motor-driven tool illustrated in FIG. 24, the respective control circuits 20, 40, and 70 may be designed to assign the number of detections of abnormal states only to the history information (Memory Content 1) at the time of shifting to a sleep state, and not to assign the number of detections of abnormal states to the other history information (Memory Contents 2 to 6).

This makes it possible to reduce an amount of data of the history information stored in the non-volatile memories 27, 45, and 69, to reduce the number of rewrites (the number of deletions, in other words) in the non-volatile memories 27, 45, and 69, and to thereby prolong the life of the non-volatile memories 27, 45, and 69.

In this case, when the history information is written into the non-volatile memories 27, 45, and 69, the history information in the past is erased, and subsequently, if power supply to the control circuits 20, 40, and 70 is shut off before the control circuits 20, 40, and 70 shift to a sleep state, the number of detections of abnormal states counted so far would disappear.

Therefore, in such a case, it is recommendable that, when the respective control circuits 20, 40, and 70 have erased the history information respectively stored in the non-volatile memories 27, 45, and 69, the number of detections of abnormal states recognized at that point is stored in the non-volatile memories 27, 45, and 69, respectively.

In the above-described embodiments, the motor-driven tool 2 has been explained as being operated by receiving power supply from the battery pack 4. However, as illustrated in FIG. 25, even when the motor-driven tool 2 includes a power-supply plug 91 for connection to a commercial power source that supplies AC power and a motor 94 is driven by the AC power obtained via the power-supply plug 91, the present invention can be applied in a manner similar to that in the above-described embodiments.

Figure 25:
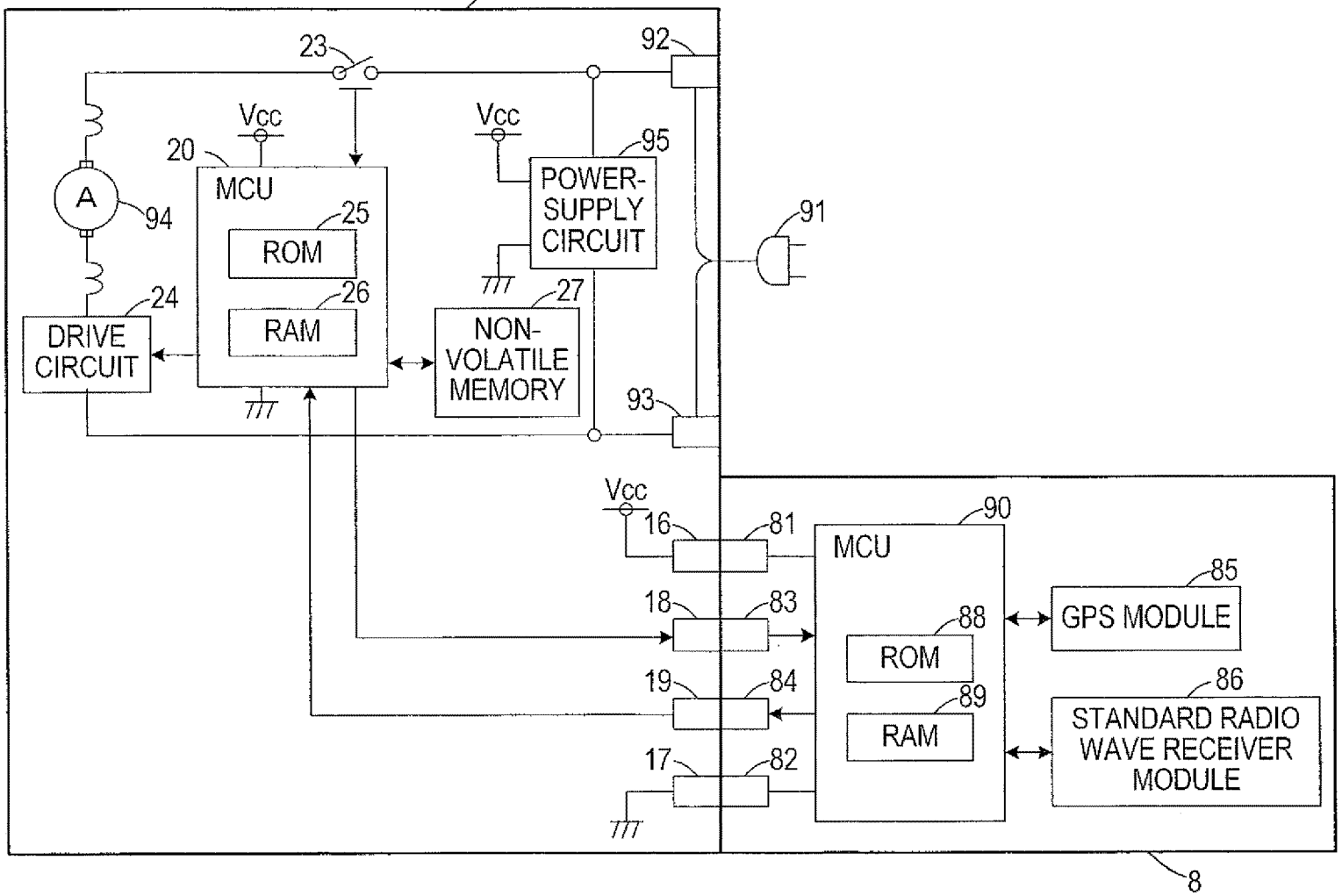
FIG. 25 is a block diagram showing a connection state of the external appliance to the motor-driven tool that is operated by receiving power supply from a commercial power source.

In short, in the motor-driven tool 2 shown in FIG. 25, the drive circuit 24 that drives the motor 94 by receiving the AC power is provided, and the control circuit 20 drive-controls the motor 94 via the drive circuit 24. Further, in the motor-driven tool 2 shown in FIG. 25, a power-supply circuit 95 is provided that generates a power-supply voltage (DC constant voltage) Vcc for driving an internal circuit by receiving the AC power.

In the thus-configured motor-driven tool 2 too, effects similar to those of the motor-driven tool 2 in the above-described embodiments can be obtained if the terminals 16 to 19 for connection to the external appliance 8 are provided and the control circuit 20 acquires the date/time information by communicating with the external appliance 8 via the terminals 18 and 19 for communication.

Figure 26:
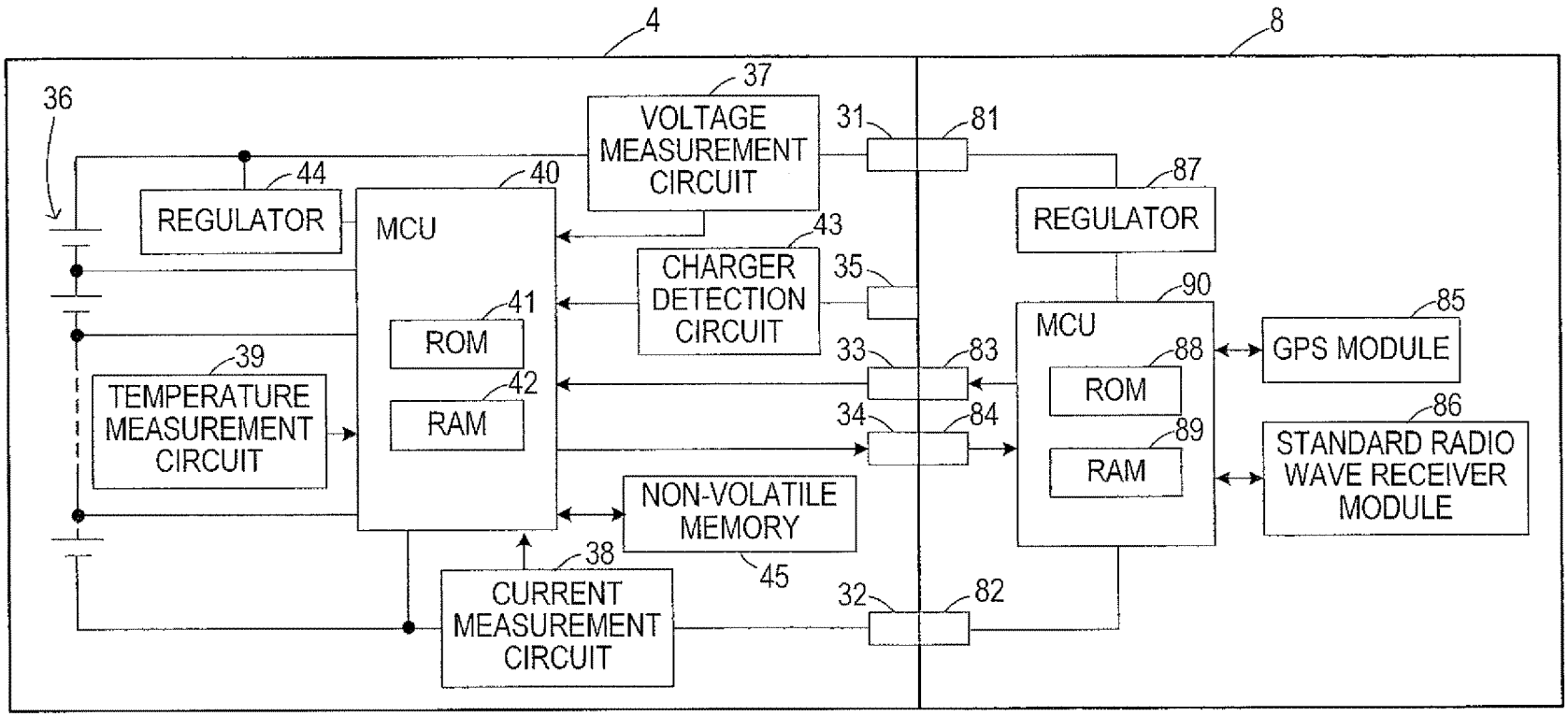
FIG. 26 is a block diagram showing a connection state of the external appliance to the battery pack.

In the above-described embodiments, the battery pack 4 has been explained as being configured to be attachable selectively to the motor-driven tool 2 or the charger 6 and to acquire the date/time information from the motor-driven tool 2 or the charger 6. However, as illustrated in FIG. 26, the battery pack 4 may be configured to be able to be connected not only to the motor-driven tool 2 and the charger 6 but also to the external appliance 8. This enables the control circuit 40 in the battery pack 4 to directly acquire the date/time information from the external appliance 8.

In the above-described embodiments, the external appliance 8 has been explained as being a mobile communication terminal including the GPS module 85 and the standard radio wave receiver module 86 that can acquire accurate date and time from radio waves transmitted from GPS satellites and standard radio waves, and as being connectable directly to the motor-driven tool 2 and the charger 6.

Figure 27:
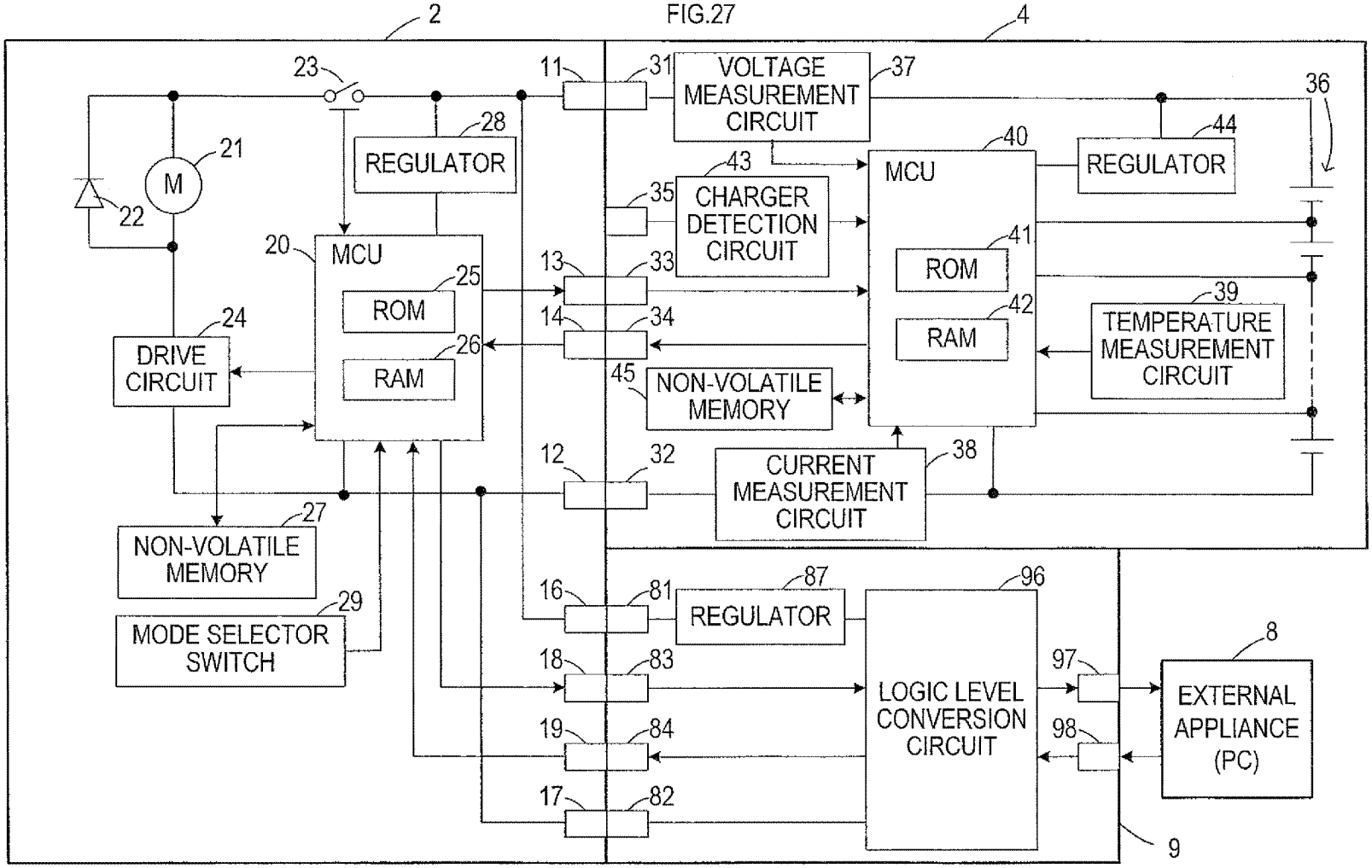
FIG. 27 is an explanatory diagram showing an adaptor used to acquire date/time information from the external appliance.

However, as illustrated in FIG. 27, for example, when the external appliance 8 is a personal computer (PC) and cannot be connected directly to the motor-driven tool 2 or the charger 6, an adaptor 9 that relays a communication with the external appliance 8 may be connected to the motor-driven tool 2 or the charger 6.

This enables the motor-driven tool 2 or the charger 6 to communicate with the external appliance 8 via the adaptor 9 and to acquire accurate date/time information from the external appliance 8.

The adaptor 9 includes the terminals 81 and 82 for receiving power supply from the motor-driven tool 2 or the charger 6, the terminals 83 and 84 for connection to the motor-driven tool 2 or the charger 6, and communication terminals 97 and 98 for connection to the external appliance 8.

Between the terminals 83 and 84 and the communication terminals 97 and 98, a logic level conversion circuit 96 is provided that converts communication signals transmitted/received by the respective devices to a proper logic level, and to the terminal 81, the regulator 87 is connected that supplies power to the logic level conversion circuit 96.

In the above-described embodiments and modified examples, the motor-driven tool 2, the charger 6, and the battery pack 4 have been explained as being configured to be connectable to the external appliance 8 via the terminals in order to acquire the date/time information from the external appliance 8.

However, in order that the motor-driven tool 2, the battery pack 4, and the charger 6 may acquire the date/time information from the external appliance 8, it is not necessarily required that the external appliance 8 is configured to be connected via the terminals, and the date/time information may be acquired by performing wireless communication with the external appliance 8. Alternatively, communication between the motor-driven tool 2, the battery pack 4, and the charger 6 and the external appliance 8 may be performed through power lines utilized for supplying power to the external appliance 8.

In the above-described embodiments and modified examples, the cases have been explained in which the present invention is applied to the motor-driven tool 2, the battery pack 4, and the charger 6, which constitute the motor-driven tool system, or the motor-driven tool 2 operated by receiving AC power from a commercial power source. However, the present invention may be applied, for example, to a motor-driven working machine, such as a grass cutter and a vacuum cleaner.

In the above-described embodiments and modified examples, the non-volatile memories 27, 45, and 69 are provided separately from the control circuits 20, 40, and 70, respectively. However, a non-volatile memory may be provided within an MCU constituting the control circuits 20, 40, and 70.

The history information stored in the non-volatile memories 27, 45, and 69 may be made viewable by being copied or transferred to information equipment, such as a personal computer (PC), and being processed variously in the information equipment.

Especially, according to the system shown in FIG. 27, since the PC as the external appliance 8 can be connected to the motor-driven tool 2 via the adaptor 9, information in the non-volatile memory 27 can be easily copied or transferred to the external appliance 8. Thus, it becomes possible for the user to view the history information stored in the non-volatile memory 27 by utilizing the PC as the external appliance 8.

In the above-described embodiments and modified examples, the external appliance 8 has been explained as being constituted as a separate body from the motor-driven tool 2 and the charger 6. However, for example, it would be possible to provide the motor-driven tool 2 (or the charger 6) with a function of the external appliance 8 (a date/time information detection function utilizing the GPS module 85, the standard radio wave receiver module 86, and the like) and to have the motor-driven tool 2 (or the charger 6), as an external appliance with respect to the battery pack 4, provide the date/time information to the battery pack 4.

What is claimed is:

1. A motor-driven tool configured to operate upon being supplied with electric power from one of at least one battery pack and an AC power source, the motor-driven tool comprising:

a communication unit that performs communication with an external appliance having a date and time information indicating a current date and time, the communication unit having an input terminal;

a date and time information acquisition unit in the motor-driven tool that acquires the date and time information from the external appliance via the input terminal of the communication unit; and a control unit that performs control based on the date and time information acquired by the date and time information acquisition unit, wherein the control unit is configured to determine whether the date and time information has been acquired from the external appliance by an external date and time acquisition completion flag and, if the external date and time acquisition completion flag is not set, the date and time information is acquired from the battery pack so as to perform the control.

2. The motor-driven tool according to claim 1, comprising a measurement unit that measures a current date and time, wherein the control unit updates the current date and time measured by the measurement unit, based on the date and time information acquired by the date and time information acquisition unit.

3. The motor-driven tool according to claim 1, comprising a measurement unit that measures a current date and time, wherein the control unit generates a difference information indicating a difference between the current date and time measured by the measurement unit and a date and time obtained from the date and time information acquired by the date and time information acquisition unit.

4. The motor-driven tool according to claim 1, wherein, when the motor-driven tool is connected to another device for a motor-driven appliance, the control unit provides the date and time information acquired by the date and time information acquisition unit to the another device for a motor-driven appliance.

5. The motor-driven tool according to claim 1, wherein the communication unit is communicatable with at least one of a GPS receiver, a standard radio wave receiver, a mobile communication terminal, and a personal computer as the external appliance.

6. The motor-driven tool according to claim 1, comprising a storage unit that stores a history of an operation of the motor-driven tool, wherein the control unit associates a history information indicating the history of the operation with the date and time information, and stores the history information in the storage unit.

7. The motor-driven tool according to claim 6, wherein the control unit counts a number of occurrences of the operation corresponding to the history information, and assigns the number of occurrences of the operation to the history information when storing the history information in the storage unit.

8. The motor-driven tool according to claim 1, wherein the external appliance comprises at least one terminal configured to attach to the motor-driven tool.

9. The motor-driven tool according to claim 1, wherein the control unit is further configured to clear an external date and time transfer completion flag if a current date and time is acquired from the external appliance, and to set the external date and time transfer completion flag, if the date and time information has been notified to the battery pack.

10. The motor-driven tool according to claim 1, wherein a control circuit of the control unit and the external appliance are connected via at least one terminal configured to relay power supply to the external appliance and via at least one terminal configured to be used for communicatable connection of the control circuit with the external appliance.

11. The motor-driven tool according to claim 1, wherein the control includes storing the date and time information.

* * * * *